US010641092B2

(12) United States Patent
Schexnaider et al.

(10) Patent No.: US 10,641,092 B2
(45) Date of Patent: May 5, 2020

(54) METHODS, APPARATUS, AND SYSTEMS FOR INJECTING AND DETECTING COMPOSITIONS IN DRILLING FLUID SYSTEMS

(71) Applicant: Halliburton Energy Services, Inc., Houston, TX (US)

(72) Inventors: Neil Patrick Schexnaider, Rayne, LA (US); James Dave Faul, II, Opelousas, LA (US); James Harold Wright, Lafayette, LA (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 66 days.

(21) Appl. No.: 15/564,651

(22) PCT Filed: May 15, 2015

(86) PCT No.: PCT/US2015/031103
§ 371 (c)(1),
(2) Date: Oct. 5, 2017

(87) PCT Pub. No.: WO2016/186616
PCT Pub. Date: Nov. 24, 2016

(65) Prior Publication Data

US 2018/0080318 A1 Mar. 22, 2018

(51) Int. Cl.
*E21B 49/08* (2006.01)
*E21B 21/01* (2006.01)
*E21B 21/06* (2006.01)

(52) U.S. Cl.
CPC ..... *E21B 49/086* (2013.01); *E21B 21/01* (2013.01); *E21B 21/062* (2013.01); *E21B 21/067* (2013.01); *E21B 21/065* (2013.01)

(58) Field of Classification Search
CPC ..... E21B 21/00; E21B 21/01; E21B 21/062; E21B 21/065; E21B 21/067; E21B 21/16; E21B 49/086; E21B 43/168
See application file for complete search history.

(56) References Cited

U.S. PATENT DOCUMENTS 4,546,640 A * 10/1985 Stone ..... E21B 49/005 73/152.19
4,577,700 A 3/1986 Dellinger et al.
(Continued)

FOREIGN PATENT DOCUMENTS

CA 2884308 A1 8/2014
WO WO 2010/093626 A2 8/2010
(Continued)

OTHER PUBLICATIONS

Schlumberger Oilfield Glossary—Wand https://www.glossary.oilfield.slb.com/en/Terms.aspx?LookIn=term%20name&filter=wand (Year: 2019).*
(Continued)

*Primary Examiner* — David Carroll
(74) *Attorney, Agent, or Firm* — Haynes and Boone, LLP

(57) ABSTRACT

Various embodiments relate to methods, apparatus, and systems for injecting and detecting compositions in drilling fluid systems. In various embodiments, the present invention provides a method of injecting and detecting a composition in a drilling fluid system. The method can include injecting the composition into the drilling fluid system. The drilling fluid system can include a gas detector. The method can also include detecting the composition with the gas detector.

21 Claims, 5 Drawing Sheets

(56) References Cited

U.S. PATENT DOCUMENTS

| | | | | |
|---|---|---|---|---|
| 4,887,464 | A * | 12/1989 | Tannenbaum | E21B 49/005 73/152.04 |
| 8,616,051 | B2 | 12/2013 | Kimour et al. | |
| 8,677,814 | B2 | 3/2014 | Evard | |
| 2012/0000278 | A1 | 1/2012 | Phillips | |
| 2012/0234599 | A1* | 9/2012 | Brumboiu | E21B 21/01 175/50 |
| 2013/0233057 | A1 | 9/2013 | Karoum et al. | |
| 2013/0270006 | A1 | 10/2013 | Selman et al. | |
| 2014/0048331 | A1 | 2/2014 | Boutalbi et al. | |
| 2014/0130671 | A1 | 5/2014 | DeGreeve et al. | |
| 2014/0209384 | A1 | 7/2014 | Hanson | |
| 2014/0216176 | A1 | 8/2014 | Kimour | |

FOREIGN PATENT DOCUMENTS

| | | | |
|---|---|---|---|
| WO | WO 2011/047236 | A1 | 4/2011 |
| WO | WO 2013/021010 | A1 | 2/2013 |

OTHER PUBLICATIONS

Collins English Dictionary—Wand https://www.collinsdictionary.com/dictionary/english/wand (Year: 2019).*

International Search Report and The Written Opinion of the International Search Authority, or the Declaration, dated Dec. 14, 2015, PCT/US2015/031103, 19 pages, ISA/KR.

Office Action issued for Canadian Patent Application No. 2,982,273 dated Apr. 11, 2019, 6 pages.

* cited by examiner

METHODS, APPARATUS, AND SYSTEMS FOR INJECTING AND DETECTING COMPOSITIONS IN DRILLING FLUID SYSTEMS

CROSS-REFERENCE TO RELATED APPLICATION

This application is a U.S. National Stage patent application under 35 USC 371 of International Patent Application No. PCT/US2015/031103, filed on May 15, 2015, the benefit of which is claimed. The entire disclosure of this prior application is incorporated herein by this reference in its entirety.

BACKGROUND

Drilling fluids are often circulated downhole during drilling operations and perform a number of functions, such as lubricating the area being drilled and removing cuttings that are created during drilling. Once the drilling fluids are returned to the surface, the cuttings can be removed and the drilling fluids can be sent back downhole for reuse. Properties of the drilling fluid are typically monitored during drilling operations. For example, it is often desirable to accurately measure gas concentrations in the drilling fluid, such as hydrocarbon gas concentrations, as the drilling fluid leaves the wellbore. The concentration of various gases in the drilling fluid, such as the concentrations of various types of hydrocarbon gas, can provide a valuable warning system when the concentration of certain gases reach unsafe levels, thereby increasing the safety of the drilling rig and safety of the personnel involved in the drilling operation. Further, the concentration of various types of gases in the drilling fluid can be indicative of the characteristics of the formation being drilled and the drilling environment, and can provide information that can affect how the drilling operation is performed.

However, various problems with the drilling fluid system can decrease or completely eliminate the ability to accurately detect various gases and their concentrations. For example, a faulty detector or analyzer, or leaks caused by bad seals or faulty connections that allow atmospheric air into the system, can prevent or reduce the ability to accurately detect various gases or measure their concentration.

BRIEF DESCRIPTION OF THE FIGURES

The drawings illustrate generally, by way of example, but not by way of limitation, various embodiments discussed in the present document.

DETAILED DESCRIPTION OF THE INVENTION

Figure 1:
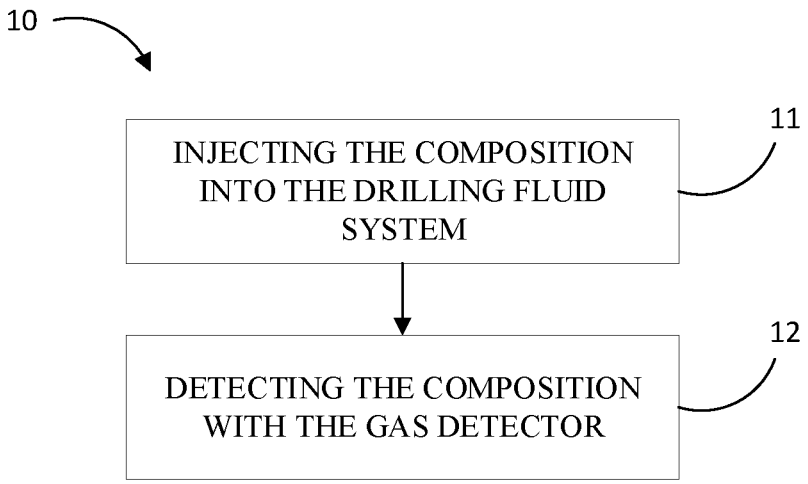
FIG. 1 illustrates a method of injecting and detecting a composition in a drilling fluid system, in accordance with various embodiments.

Reference will now be made in detail to certain embodiments of the disclosed subject matter, examples of which are illustrated in part in the accompanying drawings. While the disclosed subject matter will be described in conjunction with the enumerated claims, it will be understood that the exemplified subject matter is not intended to limit the claims to the disclosed subject matter.

In this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed herein, and not otherwise defined, is for the purpose of description only and not of limitation. Any use of section headings is intended to aid reading of the document and is not to be interpreted as limiting; information that is relevant to a section heading may occur within or outside of that particular section. A comma can be used as a delimiter or digit group separator to the left or right of a decimal mark; for example, "0.000.1" is equivalent to "0.0001."

In the methods described herein, the acts can be carried out in any order without departing from the principles of the invention, except when a temporal or operational sequence is explicitly recited. Furthermore, specified acts can be carried out concurrently unless explicit claim language recites that they be carried out separately. For example, a claimed act of doing X and a claimed act of doing Y can be conducted simultaneously within a single operation, and the resulting process will fall within the literal scope of the claimed process.

The term "about" as used herein can allow for a degree of variability in a value or range, for example, within 10%, within 5%, or within 1% of a stated value or of a stated limit of a range, and includes the exact stated value or range.

The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more, or 100%.

The term "organic group" as used herein refers to any carbon-containing functional group. For example, an oxygen-containing group such as an alkoxy group, aryloxy group, aralkyloxy group, oxo(carbonyl) group, a carboxyl group including a carboxylic acid, carboxylate, and a carboxylate ester; a sulfur-containing group such as an alkyl and aryl sulfide group; and other heteroatom-containing groups. Non-limiting examples of organic groups include OR, OOR, $OC(O)N(R)_2$, CN, $CF_3$, $OCF_3$, R, C(O), methylenedioxy, ethylenedioxy, $N(R)_2$, SR, SOR, $SO_2R$, $SO_2N(R)_2$, $SO_3R$, C(O)R, C(O)C(O)R, $C(O)CH_2C(O)R$, C(S)R, C(O)OR, OC(O)R, $C(O)N(R)_2$, $OC(O)N(R)_2$, $C(S)N(R)_2$, $(CH_2)_{0-2}N(R)C(O)R$, $(CH_2)_{0-2}N(R)N(R)_2$, N(R)N(R)C(O)R, N(R)N(R)C(O)OR, $N(R)N(R)CON(R)_2$, $N(R)SO_2R$, $N(R)SO_2N(R)_2$, N(R)C(O)OR, N(R)C(O)R, N(R)C(S)R, $N(R)C(O)N(R)_2$, $N(R)C(S)N(R)_2$, N(COR)COR, N(OR)R, $C(=NH)N(R)_2$, C(O)N(OR)R, C(=NOR)R, and substituted or unsubstituted $(C_1\text{-}C_{100})$hydrocarbyl, wherein R can be hydrogen (in examples that include other carbon atoms) or a carbon-based moiety, and wherein the carbon-based moiety can itself be substituted or unsubstituted.

The term "substituted" as used herein in conjunction with a molecule or an organic group as defined herein refers to the state in which one or more hydrogen atoms contained therein are replaced by one or more non-hydrogen atoms. The term "functional group" or "substituent" as used herein refers to a group that can be or is substituted onto a molecule or onto an organic group. Examples of substituents or functional groups include, but are not limited to, a halogen (e.g., F, Cl, Br, and I); an oxygen atom in groups such as hydroxy groups, alkoxy groups, aryloxy groups, aralkyloxy groups, oxo(carbonyl) groups, carboxyl groups including carboxylic acids, carboxylates, and carboxylate esters; a sulfur atom in groups such as thiol groups, alkyl and aryl sulfide groups, sulfoxide groups, sulfone groups, sulfonyl groups, and sulfonamide groups; a nitrogen atom in groups such as amines, hydroxyamines, nitriles, nitro groups, N-oxides, hydrazides, azides, and enamines; and other heteroatoms in various other groups. Non-limiting examples of substituents that can be bonded to a substituted carbon (or other) atom include F, Cl, Br, I, OR, $OC(O)N(R)_2$, CN, NO, $NO_2$, $ONO_2$, azido, $CF_3$, $OCF_3$, R, O (oxo), S (thiono), C(O), S(O), methylenedioxy, ethylenedioxy, $N(R)_2$, SR, SOR, $SO_2R$, $SO_2N(R)_2$, $SO_3R$, C(O)R, C(O)C(O)R, $C(OCH_2C(O)R$, C(S)R, C(O)OR, OC(O)R, $C(O)N(R)_2$, $OC(O)N(R)_2$, $C(S)N(R)_2$, $(CH_2)_{0-2}N(R)C(O)R$, $(CH_2)_{0-2}N(R)N(R)_2$, N(R)N(R)C(O)R, N(R)N(R)C(O)OR, N(R)N(R)$CON(R)_2$, $N(R)SO_2R$, $N(R)SO_2N(R)_2$, N(R)C(O)OR, N(R)C(O)R, N(R)C(S)R, $N(R)C(O)N(R)_2$, $N(R)C(S)N(R)_2$, N(COR)COR, N(OR)R, $C(=NH)N(R)_2$, C(O)N(OR)R, and C(=NOR)R, wherein R can be hydrogen or a carbon-based moiety; for example, R can be hydrogen, $(C_1\text{-}C_{100})$hydrocarbyl, alkyl, acyl, cycloalkyl, aryl, aralkyl, heterocyclyl, heteroaryl, or heteroarylalkyl; or wherein two R groups bonded to a nitrogen atom or to adjacent nitrogen atoms can together with the nitrogen atom or atoms form a heterocyclyl.

The term "alkyl" as used herein refers to straight chain and branched alkyl groups and cycloalkyl groups having from 1 to 40 carbon atoms, 1 to about 20 carbon atoms, 1 to 12 carbons or, in some embodiments, from 1 to 8 carbon atoms. Examples of straight chain alkyl groups include those with from 1 to 8 carbon atoms such as methyl, ethyl, n-propyl, n-butyl, n-pentyl, n-hexyl, n-heptyl, and n-octyl groups. Examples of branched alkyl groups include, but are not limited to, isopropyl, iso-butyl, sec-butyl, t-butyl, neopentyl, isopentyl, and 2,2-dimethylpropyl groups. As used herein, the term "alkyl" encompasses n-alkyl, isoalkyl, and anteisoalkyl groups as well as other branched chain forms of alkyl. Representative substituted alkyl groups can be substituted one or more times with any of the groups listed herein, for example, amino, hydroxy, cyano, carboxy, nitro, thio, alkoxy, and halogen groups.

The term "aryl" as used herein refers to cyclic aromatic hydrocarbon groups that do not contain heteroatoms in the ring. Thus aryl groups include, but are not limited to, phenyl, azulenyl, heptalenyl, biphenyl, indacenyl, fluorenyl, phenanthrenyl, triphenylenyl, pyrenyl, naphthacenyl, chrysenyl, biphenylenyl, anthracenyl, and naphthyl groups.

The term "heterocyclyl" as used herein refers to aromatic and non-aromatic ring compounds containing three or more ring members, of which one or more is a heteroatom such as, but not limited to, N, O, and S.

The terms "halo," "halogen," or "halide" group, as used herein, by themselves or as part of another substituent, mean, unless otherwise stated, a fluorine, chlorine, bromine, or iodine atom.

The term "hydrocarbon" or "hydrocarbyl" as used herein refers to a molecule or functional group, respectively, that includes carbon and hydrogen atoms. The term can also refer to a molecule or functional group that normally includes both carbon and hydrogen atoms but wherein all the hydrogen atoms are substituted with other functional groups. A hydrocarbyl group can be a functional group derived from a straight chain, branched, or cyclic hydrocarbon, and can be alkyl, alkenyl, alkynyl, aryl, cycloalkyl, acyl, or any combination thereof. Hydrocarbyl groups can be shown as $(C_a\text{-}C_b)$hydrocarbyl, wherein a and b are positive integers and mean having any of a to b number of carbon atoms. For example, $(C_1\text{-}C_4)$hydrocarbyl means the hydrocarbyl group can be methyl $(C_1)$, ethyl $(C_2)$, propyl $(C_3)$, or butyl $(C_4)$, and $(C_0\text{-}C_b)$hydrocarbyl means in certain embodiments there is no hydrocarbyl group.

The term "downhole" as used herein refers to under the surface of the earth, such as a location within or fluidically connected to a wellbore.

As used herein, the term "drilling fluid" refers to fluids, slurries, or muds used in drilling operations downhole, such as during the formation of the wellbore.

As used herein, the term "fluid" refers to liquids and gels, unless otherwise indicated.

As used herein, the term "subterranean material" or "subterranean formation" refers to any material under the surface of the earth, including under the surface of the bottom of the ocean. For example, a subterranean formation or material can be any section of a wellbore and any section of a subterranean petroleum- or water-producing formation or region in fluid contact with the wellbore. Placing a material in a subterranean formation can include contacting the material with any section of a wellbore or with any subterranean region in fluid contact therewith. Subterranean materials can include any materials placed into the wellbore such as cement, drill shafts, liners, tubing, casing, or screens; placing a material in a subterranean formation can include contacting with such subterranean materials. In some examples, a subterranean formation or material can be any below-ground region that can produce liquid or gaseous petroleum materials, water, or any section below-ground in fluid contact therewith. For example, a subterranean formation or material can be at least one of an area desired to be fractured, a fracture or an area surrounding a fracture, and a flow pathway or an area surrounding a flow pathway, wherein a fracture or a flow pathway can be optionally fluidically connected to a subterranean petroleum- or water-producing region, directly or through one or more fractures or flow pathways.

As used herein, "treatment of a subterranean formation" can include any activity directed to extraction of water or petroleum materials from a subterranean petroleum- or water-producing formation or region, for example, including drilling.

As used herein, a "flow pathway" downhole can include any suitable subterranean flow pathway through which two subterranean locations are in fluid connection. The flow pathway can be sufficient for petroleum or water to flow from one subterranean location to the wellbore or vice-versa. A flow pathway can include at least one of a hydraulic fracture, and a fluid connection across a screen, across gravel pack, across proppant, including across resin-bonded proppant or proppant deposited in a fracture, and across sand. A flow pathway can include a natural subterranean passageway through which fluids can flow. In some embodiments, a flow pathway can be a water source and can include water. In some embodiments, a flow pathway can be a petroleum source and can include petroleum. In some embodiments, a flow pathway can be sufficient to divert from a wellbore, fracture, or flow pathway connected thereto at least one of water, a downhole fluid, or a produced hydrocarbon.

As used herein, the term "fluidically connected" indicates that fluid may flow directly or indirectly through the components that are fluidically connected to one another.

In various embodiments, the present invention provides a method of injecting and detecting a composition in a drilling fluid system. The method includes injecting the composition into the drilling fluid system. The drilling fluid system includes a gas detector. The method also includes detecting the composition with the gas detector.

In various embodiments, the present invention provides a method of injecting and detecting a gas composition in a drilling fluid system. The method includes triggering a valve to release the gas composition from a storage container. The method includes injecting the released gas composition into the drilling fluid system through an injection tube. The drilling fluid system includes a drill string disposed in a wellbore. The drill string includes a drill bit at a downhole end of the drill string. The drilling fluid system includes an annulus between the drill string and the wellbore. The drilling fluid system includes a pump configured to circulate drilling fluid through the drill string, through the drill bit, and back above-surface through the annulus. The drilling fluid system includes an inline extraction body including a suction assembly tube in a suction orifice in a wall of a tubular. The tubular at least partially encloses the drilling fluid system. A sampling end of the suction assembly tube is disposed within an inner diameter of the tubular. The injection tube extends into the drilling fluid system from the inner wall of the tubular and is within the suction assembly tube. The drilling fluid system also includes a gas detector. The method includes directing a gas sample from the drilling fluid system through the suction assembly tube to a gas extractor fluidically connected to a gas detector. The method also includes detecting the gas composition with the gas detector.

In various embodiments, the present invention provides an injection and detection system. The injection and detection system includes a drilling fluid system. The injection and detection system includes an injector configured to inject a composition into the drilling fluid system. The injection and detection system includes a gas detector configured to detect the composition.

In various embodiments, the present invention provides a gas injection and detection system including a drilling fluid system. The drilling fluid system includes a drill string disposed in a wellbore, with the drill string including a drill bit at a downhole end of the drill string. The drilling fluid system includes an annulus between the drill string and the wellbore. The drilling fluid system includes a pump configured to circulate drilling fluid through the drill string, through the drill bit, and back above-surface through the annulus. The gas injection and detection system includes an inline extraction body fluidically connected to a gas extractor. The inline extraction body includes a suction assembly tube in a suction orifice in a wall of a tubular. The tubular at least partially encloses the drilling fluid system. A sampling end of the suction assembly tube is disposed within an inner diameter of the tubular. The inline extraction body is configured to provide a drilling fluid sample from the drilling fluid system to the gas extractor. The gas injection and detection system includes a gas detector fluidically connected to the gas extractor. The gas extractor is configured to provide a gas sample from the drilling fluid sample to the gas detector. The gas injection and detection system also includes an injection tube extending into the drilling fluid system from the inner wall of the tubular. The injection tube is within the suction assembly tube.

In various embodiments, the present invention provides an injection and detection apparatus. The injection and detection apparatus includes an inline extraction body. The inline extraction body includes a suction assembly tube configured to be placed in a suction orifice in a wall of a tubular that at least partially encloses a drilling fluid system with the sampling end of the suction assembly tube disposed within an inner diameter of the tubular. The suction assembly tube is configured to direct a gas sample from the drilling fluid system to a gas detector. The apparatus also includes an injection tube within the suction assembly tube, with the injection tube configured to extend into the drilling fluid system from the inner wall of the tubular. The injection tube is configured to inject a composition into the drilling fluid system.

In various embodiments, the method, apparatus, or system of the present invention provides certain advantages over current technology, at least some of which are unexpected. For example, in various embodiments, the present invention can determine whether and to what degree there is system integrity between the location of injection of the composition and the location of detection of the composition. For example, in various embodiments, by injecting a composition in one location of a drilling fluid system and detecting the composition in another location, communication between the location of injection and the location of detection in the drilling fluid system can be proven, such as gas communication, liquid communication, or both. In some embodiments, the invention provides a method, system, or apparatus for proving communication between the injection location and the detection location. For example, in various embodiments, the invention can be used to prove communication between a mud stream wherein the composition is injected and a gas detection system downstream of the injection point. In various embodiments, the present invention allows demonstrating gas or liquid communication between two points in the system more quickly and at lower cost than other methods.

In various embodiments, the present invention can accurately measure gas or liquid system lag time (e.g., gas or liquid transit time) between the location of injection of the composition in the drilling fluid system and the location of detection of the composition. In some embodiments, the invention provides a method, system, or apparatus for measuring lag time between the injection location and the detection location. For example, in various embodiments, by injecting the composition such that the composition is transported from above-surface, downhole to the drilling area, and back above-surface, the surface lag time of the drilling fluid system can be accurately measured. In various embodiments, the present invention allows measurement of gas or liquid lag time between two points in a drilling fluid system more quickly and at lower cost than other methods.

In various embodiments, the present invention can provide a more versatile and on-demand method, which can be used when circulating drilling fluid, when the drilling fluid is static, or when the drilling fluid system is dry. In various embodiments, the present invention can be performed while only momentarily impacting well gas data (e.g., between the injection of the composition and the detection of the composition).

Method of Injecting and Detecting a Composition in a Drilling Fluid System.

In various embodiments, the present invention provides a method of injecting and detecting a composition in a drilling fluid system. The method can be any suitable method that can be carried out by an embodiment of the system for injecting and detecting a composition or an embodiment of the apparatus for injecting and detecting a composition described herein.

FIG. 1 illustrates an embodiment of the method of injecting and detecting a composition in a drilling fluid system. The method 10 of injecting and detecting the composition can include injecting 11 the composition into the drilling fluid system. The drilling fluid system can include a gas detector. The method can also include detecting 12 the composition with the gas detector.

The method can include injecting the composition into the drilling fluid system. The injecting can be any suitable injecting, such that the composition moves from outside the drilling fluid system to within the drilling fluid system. The injecting can include triggering a valve (e.g., manually opening or electronically opening) to release the composition from a storage container into the drilling fluid system.

The injected composition can be a liquid composition, a gas composition, or a combination thereof. In some embodiments, the composition can be any suitable one or more gaseous components. The liquid composition can include any suitable liquid, such a liquid substituted or unsubstituted ($C_2$-$C_{50}$)hydrocarbon, an organic compound, a solvent, water, or a combination thereof. The gas composition can include one or more gaseous substituted or unsubstituted ($C_2$-$C_{30}$)hydrocarbons. The gas composition can be a gas at the time of injecting. The gas composition can be a gas outside the drilling fluid system immediately before the injecting and during the injecting, in contrast with a calcium carbide method of placing gas in a system which includes placing solid calcium carbide in the system which later reacts with water to form acetylene gas. In various embodiments, the gas composition can be free of acetylene produced from calcium carbide. After the injection, the one or more components of the gas composition can independently be dissolved in the drilling fluid, be partially dissolved in the drilling fluid, or remain a gas.

The injecting can include injecting into any suitable entry point into the drilling fluid system, such as via an orifice or via an open section of the drilling fluid system that allows depositing a wand or other injection apparatus into the drilling fluid. In some embodiments, the injecting includes injecting the composition through an injection orifice into the drilling fluid system. The injection orifice can be a suitable orifice for injecting the composition into the drilling fluid system and can be located in any suitable location in the drilling fluid system. The injection orifice is an orifice in a wall of a tubular that encloses at least part of the drilling fluid system. The injecting through the orifice can be directly injecting through the orifice or injecting through a body or tube disposed in the orifice, such as a wand or an injection tube. The injecting can include injecting the composition through an injection tube that extends into the drilling fluid system.

The injection tube can be a wand that allows convenient placement of the injected composition. The drilling fluid system can include a shale shaker and a settling pool upstream of the shale shaker. The settling pool can allow the momentum of the drilling fluid to be dissipated before the drilling fluid enters the shale shaker, to help avoid the momentum of the drilling fluid carrying the drilling fluid over the shale shaker without allowing it time to filter through the screens in the shale shaker. The injecting of the composition can include injecting the composition through the wand into the settling pool (e.g., under the surface of the drilling fluid). The settling pool can be in a possum belly, a distribution box, a flowline trap, or a combination thereof. The detecting of the composition can include extracting a gas sample from the drilling fluid system with a gas extractor, such as a gas extractor that is above the settling pool, above the shale shaker, above a mud ditch downstream of the shale shaker, or a combination thereof.

The detecting of the composition with the gas detector can be any suitable detecting. In embodiments including injection of a liquid composition, the detecting of the composition can include detecting one or more volatilized components of the liquid composition (e.g., detecting one or more components that have changed from a liquid to a gas). The detecting of one or more gaseous components of the composition can include detecting an increase in signal strength of a gas signature from the drilling fluid system, such as a hydrocarbon signature (e.g., an injected component adds to a hydrocarbon signature). The detecting can include detecting liquid components with the gas detector via detection of a drop in signal strength of a gas signature from the drilling fluid system, such as a hydrocarbon signature (e.g., one or more components of the injected liquid composition can remain unvolatilized and can act as a slug that defers or displaces the hydrocarbon signature). The one of more detected components of a liquid composition, via detection of a volatilized component or detection or a drop in signal strength from a hydrocarbon signature, can include detecting the one or more components in diluted form (e.g., mixed with other gases or liquids in the drilling fluid system). In various embodiments, injection of a liquid composition can have advantages such as more similar pumping and transporting of the liquid composition as the drilling fluid, and less disruption of the drilling fluid circuit as a whole.

The detecting of an injected gas composition with the gas detector can be any suitable detecting. The detecting of the gas composition can including detecting a single component of the gas composition or multiple components. The detecting of the gas composition can optionally include detecting the concentration or volume of one or more components of the gas composition. The gas composition that is detected can be different than the gas composition that is injected, due to dilution of the gas composition with other gases in the drilling fluid system, due to the addition of other gases to the gas composition within drilling fluid system, and due to reaction of or loss of one or more components of the gas composition before the detecting. The detecting of the gas composition can include detecting the gas composition in diluted form, for example, detecting the gas composition mixed with other gases in the drilling fluid system (e.g., mixed with atmospheric gases, produced gases, or other gases). The total volume of the gas sample that enters the gas detector can be less than 100 volume % of the injected composition, such as about 0.000.001 vol % to about 99 vol % of the composition, or about 0.01 vol % to about 50 vol %, or about 0.000.001 vol % or less, or about 0.000.01 vol %, 0.000.1, 0.001, 0.01, 0.1, 1, 2, 3, 4, 5, 6, 8, 10, 12, 14, 16, 18, 20, 25, 30, 35, 40, 45, 50, 55, 60, 65, 70, 75, 80, 82, 84, 86, 88, 90, 91, 92, 93, 94, 95, 96, 97, 98, 99, 99.9, 99.99, 99.999, or about 99.999.9 vol % or more.

The method can include directing a gas sample from the drilling fluid system to the gas detector. Directing the gas sample to the gas detector can include directing a sample of drilling fluid that includes the gas sample (e.g., as a homogeneous or heterogeneous mixture of fluid and gas, optionally including one or more components of the gas sample in the form of gas partially or fully dissolved in the fluid), which can first be passed through a gas extractor to separate liquid components of the drilling fluid from the gas sample, which can then be passed to the gas detector. The gas detector can be fluidically connected to the gas extractor. Directing the gas sample to the gas detector can include directing a sample of gas from the drilling fluid system directly to the gas detector, such as a sample of gas that is substantially free of liquid. A gas sample substantially free of liquid can be taken from a dry drilling fluid system, or from above the drilling fluid such as over the settling pool, over the shale shaker, or above a mud ditch downstream of the shale shaker.

The drilling fluid system can include a gas extractor. The gas extractor can separate liquid and gaseous components of the drilling fluid, in order to send a gas sample from the drilling fluid system to the gas detector. The gas detector can be fluidically connected to the gas extractor. In some embodiments, such as in a partially-filled or dry drilling fluid system, the gas extractor can take a sample from the drilling fluid system that is all or mostly gaseous and pass the gaseous sample on to the gas detector with little or no separation of liquid and gaseous components. The location of injection (e.g., the location in the drilling fluid system wherein the composition is injected) and the location of detection (e.g., the location in the drilling fluid system wherein the sample of the drilling fluid system is removed) can be any suitable distance away from one another (e.g., flow distance of drilling fluid through the drilling fluid system between the two locations). For example, the drilling fluid system can include a gas extractor fluidically connected to the drilling fluid system about 0 m (i.e., meters) to about 100,000 m downstream of the injecting, or about 0 m to about 50,000 m, or about 0 m (e.g., the location of injecting can be the location of detection), 0.1 m, 0.2, 0.3, 0.4, 0.5, 0.6, 0.7, 0.8, 0.9, 1, 1.2, 1.4, 1.6, 1.8, 2, 2.5, 3, 3.5, 4, 4.5, 5, 6, 7, 8, 9, 10, 15, 20, 25, 50, 75, 100, 150, 200, 250, 500, 750, 1,000, 1,500, 2,000, 2,500, 3,000, 4,000, 5,000, 10,000, 15,000, 20,000, 25,000, 50,000, or about 100,000 m or more downstream of the injecting.

The drilling fluid system can include an inline extraction body. The inline extraction body can be fluidically connected to a gas extractor. The inline extraction body can be any suitable body with a sampling end disposed in the drilling fluid system that can remove a sample from the drilling fluid system. The inline extraction body can provide a gas sample from the drilling fluid system to the gas extractor. The gas sample provided to the gas extractor by the inline extraction body can be a sample of the drilling fluid that includes the gas sample (e.g., as a homogeneous or heterogeneous mixture, wherein one or more components of the gas sample can be partially or fully dissolved in the liquid), or a fully or mostly gaseous sample from the drilling fluid system (e.g., from a drilling fluid system that is partially or fully dry, or from an inline extraction body positioned above the level of drilling fluid in the system).

In various embodiments, the inline extraction body includes a suction assembly tube in a suction orifice in a wall of a tubular that at least partially encloses the drilling fluid system (e.g., a pipe). The method can include directing a gas sample from the drilling fluid system through the suction assembly tube to a gas extractor fluidically connected to the gas detector. A sampling end of the suction assembly tube can be disposed within an inner diameter of the tubular. In some embodiments, the injecting of the composition includes injecting the composition into the suction assembly tube, such as directly into the suction assembly tube or via another tube disposed within the suction assembly tube. The composition can be injected into the suction assembly tube such that at least some of the injected composition is swept into the suction assembly tube with drilling fluid from the drilling fluid system that is sucked into the suction assembly tube. Injecting the composition can include injecting the composition through the suction assembly tube in an injection tube that is within the suction assembly tube.

The inline extraction body can include any suitable number of outlets, such as outlets fluidically connected to the suction assembly tube. The method can include directing a first portion of drilling fluid in the drilling fluid system through the suction assembly tube and into a first outlet of the inline extraction body. In some embodiments, the first portion of the fluid can be directed to a separator. The method can include directing a second portion of drilling fluid in the drilling fluid system through the suction assembly tube and into a second outlet of the inline extraction body. In some embodiments, the second portion of the fluid can be directed to a gas extractor. In some embodiments, the second portion of the fluid is directed to an inline tee and subsequently directed to a gas extractor.

Figure 2:
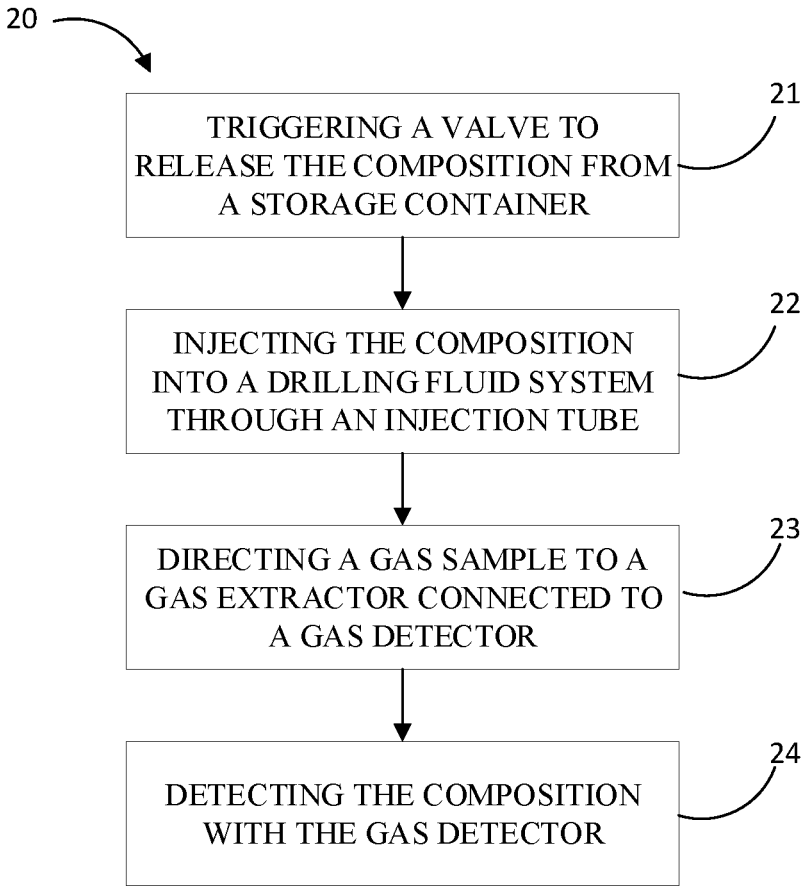
FIG. 2 illustrates a method of injecting and detecting a composition in a drilling fluid system, in accordance with various embodiments.

FIG. 2 illustrates an embodiment of the method of injecting and detecting a composition in a drilling fluid system. The method 20 of injecting and detecting the composition can include triggering 21 a valve to release the composition from a storage container. The method can include injecting 22 the released composition into the drilling fluid system through an injection tube. The drilling fluid system can include a drill string disposed in a wellbore. The drill string can include a drill bit at a downhole end of the drill string. The drilling fluid system can include an annulus between the drill string and the wellbore. The drilling fluid system can include a pump configured to circulate drilling fluid through the drill string, through the drill bit, and back above-surface through the annulus. The drilling fluid system can include an inline extraction body including a suction assembly tube in a suction orifice in a wall of a tubular. The tubular can at least partially enclose the drilling fluid system. A sampling end of the suction assembly tube can be disposed within an inner diameter of the tubular. The injection tube can extend into the drilling fluid system from the inner wall of the tubular and can be within the suction assembly tube. The drilling fluid system can also include a gas detector. The method can include directing 23 a gas sample from the drilling fluid system through the suction assembly tube to a gas extractor fluidically connected to a gas detector. The method can also include detecting 24 the composition with the gas detector.

Injection and Detection System.

In various embodiments, the present invention provides an injection and detection system. The injection and detection system can be a gas injection and detection system. The injection and detection system can be any suitable system that includes an embodiment of the injection and detection apparatus or that can perform an embodiment of the injection and detection method described herein. The injection and detection system can include a drilling fluid system. The injection and detection system can include an injector (e.g., a gas injector, a liquid injector, or a combination thereof) configured to inject a composition into the drilling fluid system. The injection and detection system can also include a gas detector configured to detect the composition.

Figure 3:
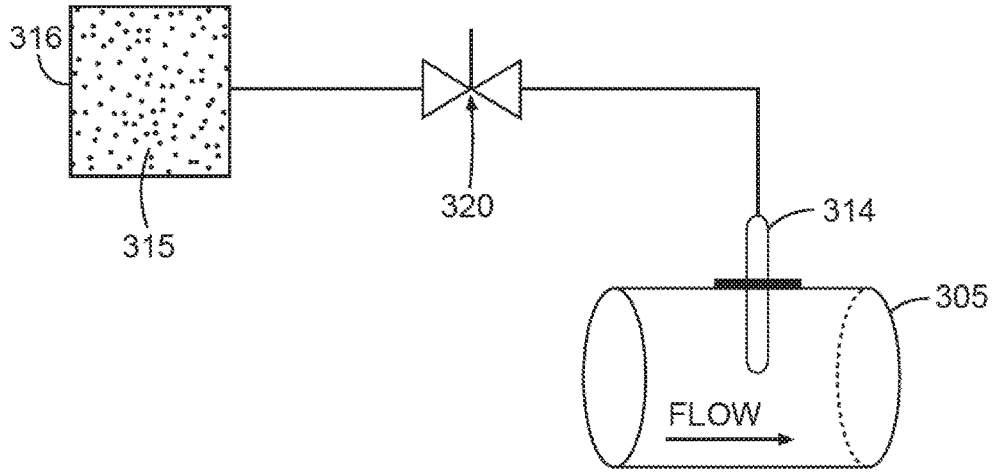
FIG. 3 is an injection and detection system, in accordance with various embodiments.

FIG. 3 illustrates an embodiment of the injection and detection system. The system 300 can include a drilling fluid system 305 (note that only a tubular from the drilling fluid system is shown in FIG. 3). The system can include an injector 310 configured to inject a composition 315 into the drilling fluid system 305. Prior to injection, the composition 315 can be stored in a container 316 (e.g., container 316 can hold gas or liquid composition 315 under pressure). The composition can be injected by triggering valve 320. The system can include a gas detector (not shown) configured to detect the composition 315. The system can optionally include a pump (not shown) to move gaseous or liquid compositions from the container to the injector.

The drilling fluid system can be any suitable drilling fluid system. The drilling fluid system can include a tubular disposed in a subterranean formation. The drilling fluid system can include a tubular disposed in a wellbore. The drilling fluid system can include a drill string disposed in a wellbore. The drill string can include a drill bit at a downhole end of the drill string. The drilling fluid system can include an annulus between the drill string and the wellbore. The drilling fluid system can include a pump that is configured to circulate drilling fluid through the drilling fluid system, such as through the drill string, through the drill bit, and back above-surface through the annulus. The drilling fluid can include a drilling fluid, such as an aqueous drilling fluid or an oil-based drilling fluid. The drilling fluid system can include a circulating drilling fluid. The drilling fluid system can include a static drilling fluid. In some embodiments, the drilling fluid system is substantially free of circulating or static drilling fluid.

Figure 4:
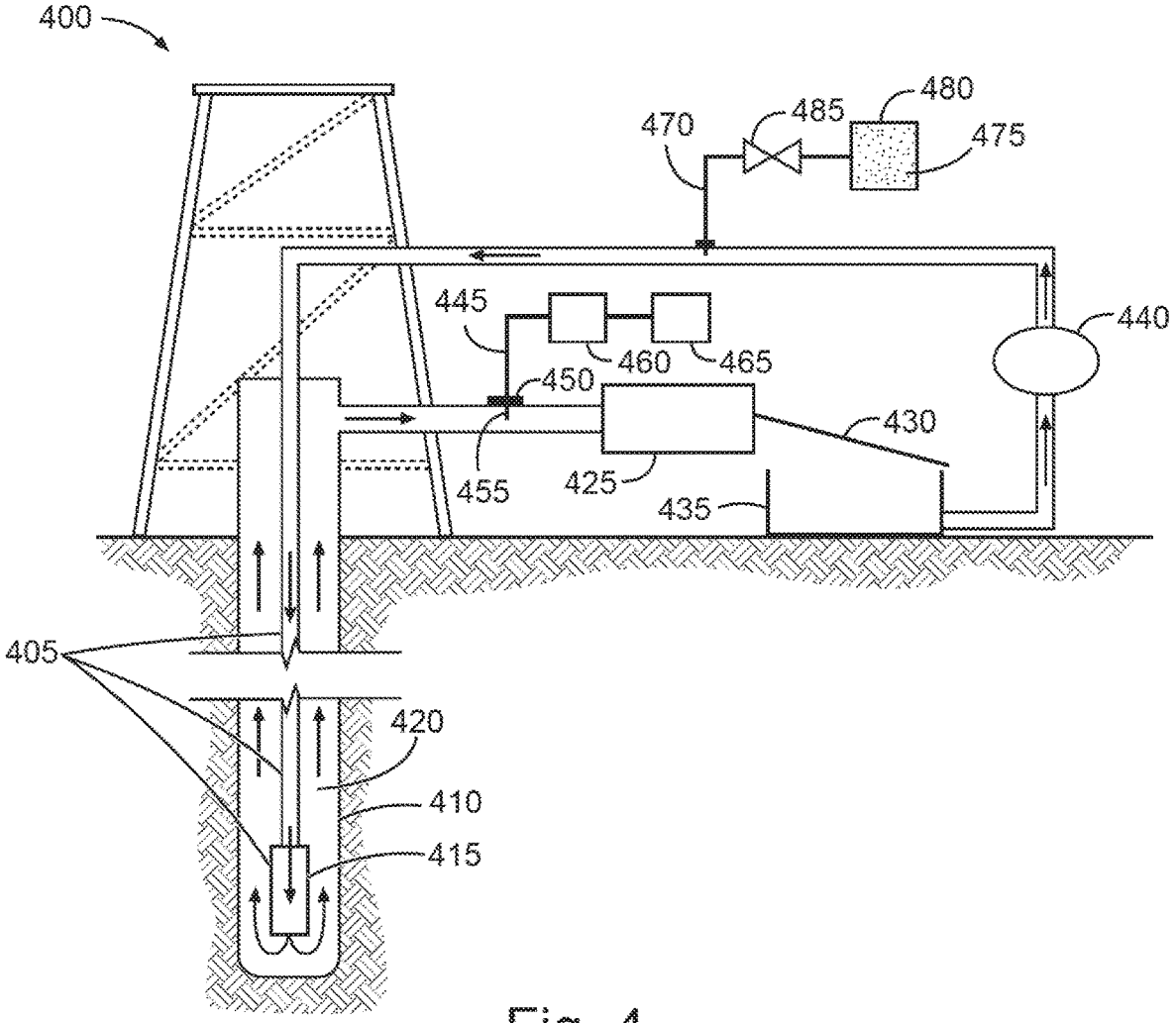
FIG. 4 is an injection and detection system, in accordance with various embodiments.

FIG. 4 illustrates an embodiment of the injection and detection system. The injection and detection system 400 can include a drilling fluid system. The drilling fluid system can include a drill string 405 disposed in a wellbore 410. The drill string 405 can include a drill bit 415 at a downhole end of the drill string. The drilling fluid system can include an annulus 420 between the drill string 405 and the wellbore 410. The drilling fluid system can include a possum belly 425 having a settling pool therein. The drilling fluid system can include a shale shaker 430. The drilling fluid system can include a mud reservoir 435. The drilling fluid system can include a pump 440 configured to circulate drilling fluid through the drill string 405, through the drill bit 415, and back above-surface through the annulus 420. The injection and detection system can include a suction assembly tube 445 in a suction orifice 450 in a wall of a tubular, with the tubular at least partially enclosing the drilling fluid system. A sampling end 455 of the suction assembly tube 445 can be disposed within an inner diameter of the tubular. The suction assembly tube 445 can be configured to provide a drilling fluid sample from the drilling fluid system to the gas extractor 460. The injection and detection system 400 can include a gas detector 465 fluidically connected to the gas extractor 460. The gas extractor 460 can be configured to provide a gas sample from the drilling fluid sample to the gas detector 465. The injection and detection system 400 can include an injection tube 470 extending into the drilling fluid system from the inner wall of the tubular. The injection tube can be configured to inject a composition 475 into the drilling fluid system, such as from storage container 480 triggered by opening valve 485.

The drilling fluid system can include an injection orifice. The injection orifice can be in any suitable location in the drilling fluid system. The injection orifice can be an orifice in a wall of a tubular that encloses at least part of the drilling fluid system. The system can include an injection tube that extends into the drilling fluid system. The injection tube can be made of any suitable material, such as stainless steel. The injector can be configured to inject the composition through the injection tube and into the drilling fluid system. In some embodiments, the injection tube can be a wand. The drilling fluid can include a shale shaker and a settling pool upstream of the shale shaker. The injector can be configured to inject the composition through the wand into the settling pool (e.g., under the surface of the drilling fluid in the settling pool, such that in embodiments wherein the injected composition is a gas composition the gas composition exits the wand as bubbles that are pulled into the extraction process). The settling pool can be in a possum belly, a distribution box, a flowline trap, or a combination thereof. The system can include a gas extractor configured to extract a gas sample from the drilling fluid system above the settling pool, above the shale shaker, above a mud ditch downstream of the shale shaker, or a combination thereof. The gas extractor can be configured to direct the extracted gas sample to the gas detector.

Figure 5:
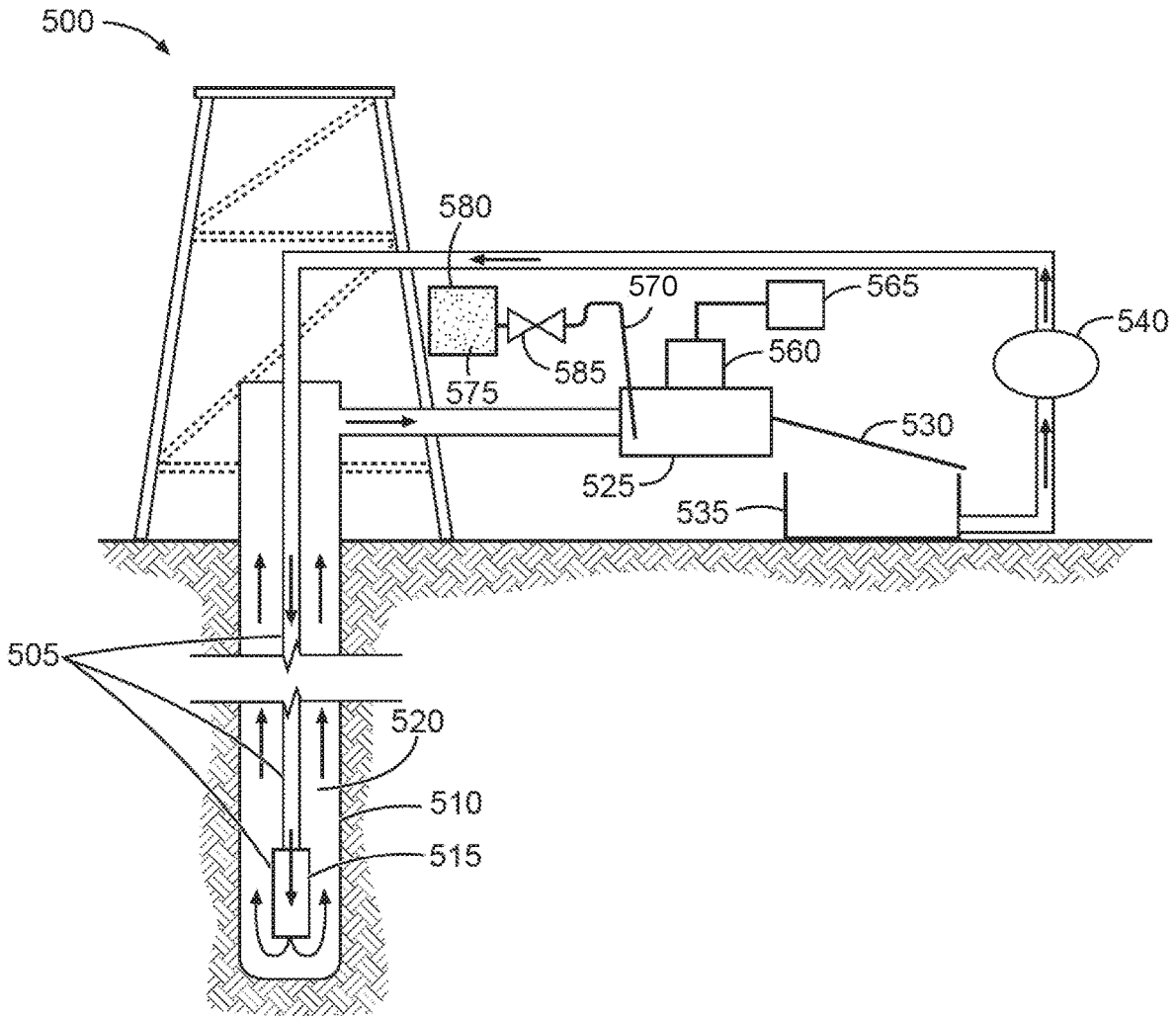
FIG. 5 is an injection and detection system, in accordance with various embodiments.

FIG. 5 illustrates an embodiment of the injection and detection system. The injection and detection system 500 can include a drilling fluid system. The drilling fluid system can include a drill string 505 disposed in a wellbore 510. The drill string 505 can include a drill bit 515 at a downhole end of the drill string. The drilling fluid system can include an annulus 520 between the drill string 505 and the wellbore 510. The drilling fluid system can include a possum belly 525 having a settling pool therein. The drilling fluid system can include a shale shaker 530. The drilling fluid system can include a mud reservoir 535. The drilling fluid system can include a pump 540 configured to circulate drilling fluid through the drill string 505, through the drill bit 515, and back above-surface through the annulus 505. The injection and detection system can include a gas extractor 560 disposed above possum belly 525. The gas extractor 560 can be configured to provide a gas sample from the drilling fluid system to the gas detector 565. The gas injection and detection system 500 can include a gas detector 565 fluidically connected to the gas extractor 560. The gas extractor 560 can be configured to provide a gas sample from the drilling fluid sample to the gas detector 565. The gas injection and detection system 500 can include an injection wand 570 extending into the possum belly 525. The injection wand can be configured to inject a composition 575 into the drilling fluid system, such as from container 580 triggered by opening valve 585.

The drilling fluid system can include a gas extractor. The gas extractor can separate liquid and gaseous components of the drilling fluid in order to send a gas sample from the drilling fluid system to the gas detector. The gas detector can be fluidically connected to the gas detector. The location of the injector and the location of the gas detector can be any suitable distance away from one another (e.g., flow distance of drilling fluid through the drilling fluid system between the two locations). For example, the drilling fluid system can include a gas extractor fluidically connected to the drilling fluid system about 0 m (i.e., meters) to about 100,000 m downstream of the injector, or about 0 m to about 50,000 m, or about 0 m (e.g., the location of injecting can be the location of detection), 0.1 m, 0.2, 0.3, 0.4, 0.5, 0.6, 0.7, 0.8, 0.9, 1, 1.2, 1.4, 1.6, 1.8, 2, 2.5, 3, 3.5, 4, 4.5, 5, 6, 7, 8, 9, 10, 15, 20, 25, 50, 75, 100, 150, 200, 250, 500, 750, 1,000, 1,500, 2,000, 2,500, 3,000, 4,000, 5,000, 10,000, 15,000, 20,000, 25,000, 50,000, or about 100,000 m or more downstream of the injector.

The drilling fluid system can include an inline extraction body. The inline extraction body can be fluidically connected to a gas extractor. The inline extraction body can be any suitable body with a sampling end disposed in the drilling fluid system that can remove a sample from the drilling fluid system. The inline extraction body can be configured to provide a gas sample from the drilling fluid system to the gas extractor. The gas sample provided to the gas extractor by the inline extraction body can be a sample of the drilling fluid that includes the gas sample (e.g., as a homogeneous or heterogeneous mixture, wherein one or more components of the gas sample can be partially or fully dissolved in the liquid), or a fully or mostly gaseous sample from the drilling fluid system (e.g., from a drilling fluid system that is partially or fully dry, or from an inline extraction body positioned above the level of drilling fluid in the system).

The inline extraction body can include a suction assembly tube in a suction orifice in a wall of a tubular, with the tubular at least partially enclosing the drilling fluid system (e.g., a pipe). The suction assembly tube can be any suitable material, such as stainless steel. A sampling end of the suction assembly tube can be disposed within an inner diameter of the tubular. The injector can be configured to inject the composition into the suction assembly tube, either directly into the suction assembly tube or via an injection tube, such that at least some of the injected composition is swept into the suction assembly tube with the drilling fluid from the drilling fluid system that is sucked into the suction assembly tube. The suction assembly tube can be configured to direct a gas sample from the drilling fluid system through the suction assembly tube to a gas extractor fluidically connected to the gas detector.

The injector can be configured to inject the composition through the suction assembly tube in an injection tube that is within the suction assembly tube. A sampling end of the suction assembly tube can be disposed within an inner diameter of the tubular. For example, the injection tube can have an outer diameter that is less than the inner diameter of the suction assembly tube, such that there is room between the outside of the injection tube and the suction assembly tube for drilling fluid samples to be sucked into the suction assembly tube and at least a portion thereof sent to a gas extractor. In some embodiments, the injection tube extends into the drilling fluid system from an inner wall of the tubular by a distance that is about the same or less than a distance that the sampling end of the suction assembly tube extends into the drilling fluid system from the inner wall of the tubular (e.g., the sampling end of the suction assembly tube can be at the same level or closer to the injection orifice in the tubular wall than the end of the injection tube from which the injected composition emerges). In some embodiments, the injection tube can extend into the drilling fluid system from an inner wall of the tubular by a distance that is about the same or greater than the distance that the sampling end of the suction assembly tube extends into the drilling fluid system from the inner wall of the tubular (e.g., the sampling end of the suction assembly tube can be farther from the injection orifice in the tubular wall than the end of the injection tube from which the injected composition emerges).

In embodiments including an injection tube that is within the suction assembly tube, the sampling end of the suction assembly tube can have any suitable spatial relationship with the end of the injection tube from which the injected composition emerges. For example, the sampling end of the suction assembly tube can be extended further into the tubular (e.g., extended in a direction transverse to the flow direction of drilling fluid) than the end of the injection tube from which the injected composition emerges by about 0 mm to about 2 m, as compared to the inner wall of the tubular, or about 0 mm to about 500 mm, or about 1 mm to about 1 m, or about 0.01 mm or less, or about 0.1 mm, 1, 2, 3, 4, 5, 6, 7, 8, 9, 10, 15, 20, 25, 30, 40, 50, 60, 70, 80, 90, 100, 150, 200, 300, 400, 500, 600, 700, 800, 900 mm, 1 m, 1.1, 1.2, 1.3, 1.4, 1.5, 1.6, 1.7, 1.8, 1.9, or about 2 m or more. For example, the end of the injection tube from which the injected composition emerges can be extended further into the tubular (e.g., extended in a direction transverse to the flow direction of drilling fluid) than the sampling end of the suction assembly tube by about 0 mm to about 2 m, as compared to the inner wall of the tubular, or about 0 mm to about 500 mm, or about 1 mm to about 1 m, or about 0.01 mm or less, or about 0.1 mm, 1, 2, 3, 4, 5, 6, 7, 8, 9, 10, 15, 20, 25, 30, 40, 50, 60, 70, 80, 90, 100, 150, 200, 300, 400, 500, 600, 700, 800, 900 mm, 1 m, 1.1, 1.2, 1.3, 1.4, 1.5, 1.6, 1.7, 1.8, 1.9, or about 2 m or more. For example, the sampling end of the suction assembly tube can be extended into the tubular in a direction transverse to the flow direction of drilling fluid by a distance the same as the end of the injection tube from which the injected composition emerges is extended into the tubular in a direction transverse to the flow direction of drilling fluid, as compared to the inner wall of the tubular. For an injection tube that allows injected materials to exit the injection tube prior to the actual end of the tube, such as via one or more holes or a screen parallel to the length of the injection tube (e.g., as part of the wall of the injection tube), the end of the injection tube through which the injected composition emerges, for purposes of comparing to the distance the sampling end of the suction assembly tube is extended into the tubular, can optionally be considered the nearest location of the injection tube to the tubular wall through which the injection tube is disposed from which the composition can exit the injection tube. For a suction assembly tube that allows suctioned materials to enter the suction assembly tube prior to the actual end of the tube, such as via one or more holes or a screen parallel to the length of the suction assembly tube, the sampling end of the suction assembly tube, for purposes of comparing to the distance the end of the injection tube through which the injected composition emerges is extended into the tubular, can optionally be considered the nearest location of the suction assembly tube to the tubular wall through which the suction assembly tube is disposed through which the composition can enter the suction assembly tube.

In embodiments including an injection tube that is within the suction assembly tube, for a suction assembly tube that allows suctioned materials to enter the suction assembly tube prior to the actual end of the tube, such as via one or more holes or a screen parallel to the length of the suction assembly tube, the end of the injection tube through which the injected composition emerges can be located between the actual end of the of the suction assembly tube and the nearest location of the suction assembly tube to the tubular wall through which the suction assembly tube is disposed through which the composition can enter the suction assembly tube. The distance between the end of the injection tube and the actual end of a suction assembly tube that allows suctioned materials to enter the suction assembly tube prior to the actual end of the suction assembly tube and can be any suitable distance, such as about 0 mm to about 2 m, or about 0 mm to about 500 mm, or about 1 mm to about 1 m, or about 0.01 mm or less, or about 0.1 mm, 1, 2, 3, 4, 5, 6, 7, 8, 9, 10, 15, 20, 25, 30, 40, 50, 60, 70, 80, 90, 100, 150, 200, 300, 400, 500, 600, 700, 800, 900 mm, 1 m, 1.1, 1.2, 1.3, 1.4, 1.5, 1.6, 1.7, 1.8, 1.9, or about 2 m or more, wherein the actual end of the suction tube can extend into the tubular further than, be even with, or extend into the tubular less than, the end of the injection tube, as compared to the inner wall of the tubular.

The inline extraction body can include any suitable number of outlets. In some embodiments, the inline extraction body is configured to direct a first portion of drilling fluid in the drilling fluid system through the suction assembly tube and into a first outlet of the inline extraction body. The first outlet of the inline extraction body can be connected to a separator. The inline extraction body can be configured to direct a second portion of drilling fluid in the drilling fluid system through the suction assembly tube and into a second outlet of the inline extraction body. The second outline of the inline extraction body can be connected to an extractor.

Injection and Detection Apparatus.

In various embodiments, the present invention provides an injection and detection apparatus. The injection and detection apparatus can be a gas injection and detection apparatus. The apparatus can be any suitable apparatus that can be used to form an embodiment of the system for injection and detection or to perform the method for injection and detection described herein.

Figure 6:
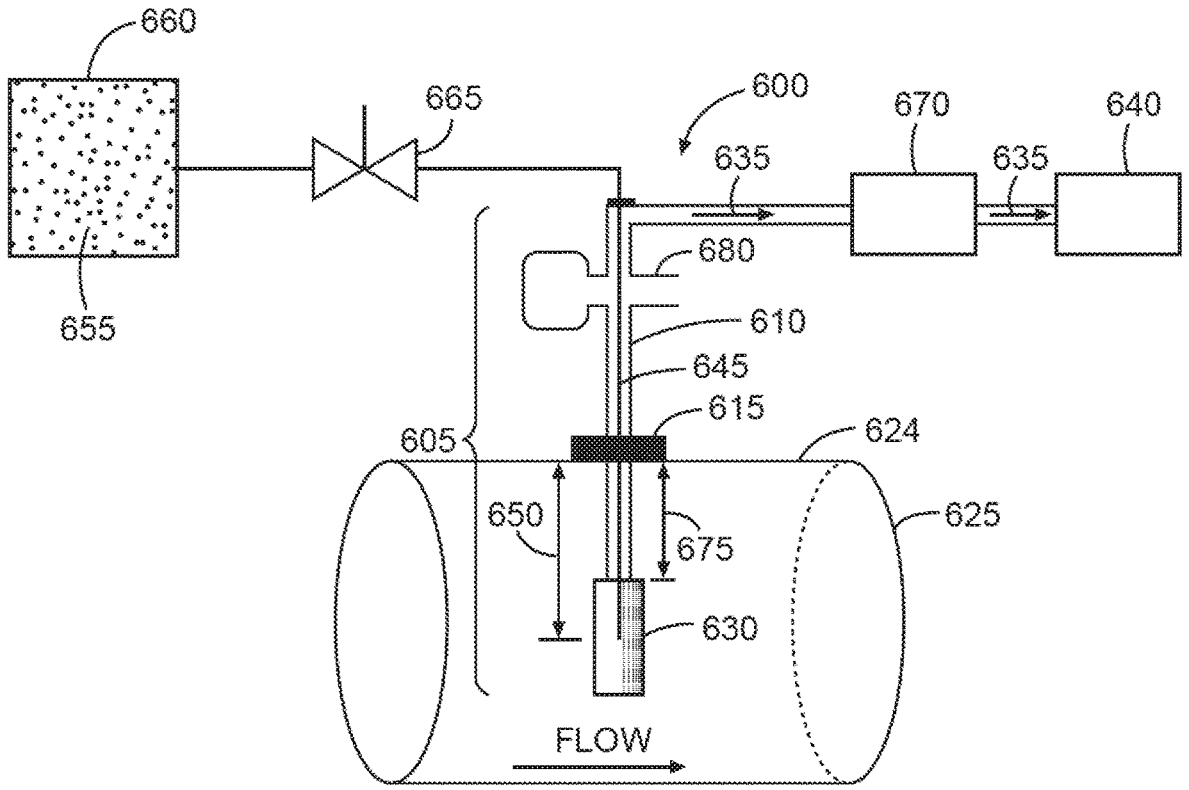
FIG. 6 is an injection and detection apparatus, in accordance with various embodiments.

FIG. 6 illustrates an embodiment of the injection and detection apparatus. The apparatus 600 can include an inline extraction body 605. In various embodiments, the inline extraction body can be a modified gas extractor. In various embodiments, the inline extraction body can be a modified inline extraction body component of a sealed system such as an EAGLE™ extraction system or a constant volume extractor (CVE) system. The inline extraction body can be a modified (e.g., modified to include an injection tube therein) inline extraction body component of a non-sealed degasser system such as a quantitative gas measurement (QGM) system. The inline extraction body 605 can include a suction assembly tube 610 configured to be placed in a suction orifice 615 in a wall 620 of a tubular 625 that at least partially encloses a drilling fluid system (the tubular is shown without the rest of the drilling fluid system) with the sampling end 630 of the suction assembly tube 610 disposed within an inner diameter of the tubular 625. The sampling end 630 of the suction assembly tube 610 can have a plurality of perforations or a screen that is parallel to the length of the suction assembly tube, such as configured to face in the same direction as the flow of drilling fluid through the tubular 625. The suction assembly tube 610 can be configured to direct a gas sample 635 from the drilling fluid system to a gas detector 640 (e.g., wherein the gas sample 635 prior to gas extractor 670 can be included in a mixture of drilling fluid and gas, or can be predominantly gas sample 635, and wherein the gas sample 635 after the gas extractor can be fully or mostly gas sample 635). The apparatus can include an injection tube 645 within the suction assembly tube 610. The injection tube 645 can be configured to extend into the drilling fluid system from the inner wall 620 of the tubular 625 by a distance 650. The injection tube 645 can be configured to inject a composition 655 into the drilling fluid system, such as from a container 660 via a valve 665.

The suction assembly tube can be configured to direct the gas sample 635 to a gas extractor 670 and subsequently to the gas detector 640. The injection tube 645 can be configured to extend into the drilling fluid system from the inner wall 620 of the tubular 625 by a distance 650 that is about the same or less than the distance 675 that the sampling end 630 of the suction assembly tube 610 is configured to extend into the drilling fluid system from the inner wall 620 of the tubular 625. The apparatus can include a gas extractor 670 fluidically connected to the suction assembly tube 610, and the gas detector 640 fluidically connected to the gas extractor 670.

The suction assembly tube 610 can include a first outlet 680 and a second outlet 685. The suction assembly tube 610 can be configured to direct a first portion of a sample from the drilling fluid system including the gas sample 635 to the first outlet 680 and a second portion of the sample from the drilling fluid system including the gas sample 635 to the second outlet 685.

Drilling Fluid.

A drilling fluid, also known as a drilling mud or simply "mud," is a specially designed fluid that is circulated through a wellbore as the wellbore is being drilled to facilitate the drilling operation. The drilling fluid can be water-based or oil-based. The drilling fluid can carry cuttings up from beneath and around the bit, transport them up the annulus, and allow their separation. Also, a drilling fluid can cool and lubricate the drill bit as well as reduce friction between the drill string and the sides of the hole. The drilling fluid aids in support of the drill pipe and drill bit, and provides a hydrostatic head to maintain the integrity of the wellbore walls and prevent well blowouts. Specific drilling fluid systems can be selected to optimize a drilling operation in accordance with the characteristics of a particular geological formation. The drilling fluid can be formulated to prevent unwanted influxes of formation fluids from permeable rocks and also to form a thin, low permeability filter cake that temporarily seals pores, other openings, and formations penetrated by the bit. In water-based drilling fluids, solid particles are suspended in a water or brine solution containing other components. Oils or other non-aqueous liquids can be emulsified in the water or brine or at least partially solubilized (for less hydrophobic non-aqueous liquids), but water is the continuous phase.

A water-based drilling fluid in embodiments of the present invention can be any suitable water-based drilling fluid. In various embodiments, the drilling fluid can include at least one of water (fresh or brine), a salt (e.g., calcium chloride, sodium chloride, potassium chloride, magnesium chloride, calcium bromide, sodium bromide, potassium bromide, calcium nitrate, sodium formate, potassium formate, cesium formate), aqueous base (e.g., sodium hydroxide or potassium hydroxide), alcohol or polyol, cellulose, starches, alkalinity control agents, density control agents such as a density modifier (e.g., barium sulfate), surfactants (e.g., betaines, alkali metal alkylene acetates, sultaines, ether carboxylates), emulsifiers, dispersants, polymeric stabilizers, crosslinking agents, polyacrylamides, polymers or combinations of polymers, antioxidants, heat stabilizers, foam control agents, solvents, diluents, plasticizers, filler or inorganic particles (e.g., silica), pigments, dyes, precipitating agents (e.g., silicates or aluminum complexes), and rheology modifiers such as thickeners or viscosifiers (e.g., xanthan gum). Any ingredient listed in this paragraph can be either present or not present in the mixture.

An oil-based drilling fluid or mud in embodiments of the present invention can be any suitable oil-based drilling fluid. In various embodiments the drilling fluid can include at least one of an oil-based fluid (or synthetic fluid), saline, aqueous solution, emulsifiers, other agents or additives for suspension control, weight or density control, oil-wetting agents, fluid loss or filtration control agents, and rheology control agents. An oil-based or invert emulsion-based drilling fluid can include between about 10:90 to about 95:5, or about 50:50 to about 95:5, by volume of oil phase to water phase. A substantially all oil mud includes about 100% liquid phase oil by volume (e.g., substantially no internal aqueous phase).

In some embodiments, the drilling fluid can include any suitable amount of any suitable material used in a downhole fluid. For example, the drilling fluid can include water, saline, aqueous base, acid, oil, organic solvent, synthetic fluid oil phase, aqueous solution, alcohol or polyol, cellulose, starch, alkalinity control agents, acidity control agents, density control agents, density modifiers, emulsifiers, dispersants, polymeric stabilizers, polyacrylamide, a polymer or combination of polymers, antioxidants, heat stabilizers, foam control agents, solvents, diluents, plasticizer, filler or inorganic particle, pigment, dye, precipitating agent, oil-wetting agents, set retarding additives, surfactants, gases, weight reducing additives, heavy-weight additives, lost circulation materials, filtration control additives, salts (e.g., any suitable salt, such as potassium salts such as potassium chloride, potassium bromide, potassium formate; calcium salts such as calcium chloride, calcium bromide, calcium formate; cesium salts such as cesium chloride, cesium bromide, cesium formate, or a combination thereof), fibers, thixotropic additives, breakers, crosslinkers, rheology modifiers, curing accelerators, curing retarders, pH modifiers, chelating agents, scale inhibitors, enzymes, resins, water control materials, oxidizers, markers, Portland cement, pozzolana cement, gypsum cement, high alumina content cement, slag cement, silica cement, fly ash, metakaolin, shale, zeolite, a crystalline silica compound, amorphous silica, hydratable clays, microspheres, lime, or a combination thereof. In various embodiments, the drilling fluid can include one or more additive components such as: COLDTROL®, ATC®, OMC 2™, and OMC 42™ thinner additives; RHEMOD™ viscosifier and suspension agent; TEMPERUS™ and VIS-PLUS® additives for providing temporary increased viscosity; TAU-MOD™ viscosifying/suspension agent; ADAPTA®, DURATONE® HT, THERMO TONE™, BDF™-366, and BDF™-454 filtration control agents; LIQUITONE™ polymeric filtration agent and viscosifier; FACTANT™ emulsion stabilizer; LE SUPERMUL™, EZ MUL® NT, and FORTI-MUL® emulsifiers; DRIL TREAT® oil wetting agent for heavy fluids; AQUATONE-S™ wetting agent; BARACARB® bridging agent; BAROID® weighting agent; BAROLIFT® hole sweeping agent; SWEEP-WATE® sweep weighting agent; BDF-508 rheology modifier; and GELTONE® II organophilic clay. In various embodiments, the drilling fluid can include one or more additive components such as: X-TEND® II, PAC™-R, PAC™-L, LIQUI-VIS® EP, BRINEDRIL-VIS™, BARAZAN®, N-VIS®, and AQUA-GEL® viscosifiers; THERMA-CHEK®, N-DRIL™, N-DRIL™ HT PLUS, IMPERMEX®, FILTERCHEK™, DEXTRID®, CARBONOX®, and BARANEX® filtration control agents; PERFORMATROL®, GEM™, EZ-MUD®, CLAY GRABBER®, CLAYSEAL®, CRYSTAL-DRIL®, and CLAY SYNC™ II shale stabilizers; NXS-LUBE™, EP MUDLUBE®, and DRIL-N-SLIDE™ lubricants; QUIK-THIN®, IRON-THIN™, THERMA-THIN®, and ENVIRO-THIN™ thinners; SOURSCAV™ scavenger; BARACOR® corrosion inhibitor; and WALL-NUT®, SWEEP-WATE®, STOPPIT™, PLUG-GIT®, BARACARB®, DUO-SQUEEZE®, BAROFIBRE™ STEEL-SEAL®, and HYDRO-PLUG® lost circulation management materials. Any suitable proportion of the composition or mixture including the composition can include any optional component listed in this paragraph, such as about 0.001 wt % to about 99.999 wt %, about 0.01 wt % to about 99.99 wt %, about 0.1 wt % to about 99.9 wt %, about 20 to about 90 wt %, or about 0.001 wt % or less, or about 0.01 wt %, 0.1, 1, 2, 3, 4, 5, 10, 15, 20, 30, 40, 50, 60, 70, 80, 85, 90, 91, 92, 93, 94, 95, 96, 97, 98, 99, 99.9, 99.99 wt %, or about 99.999 wt % or more of the composition or mixture.

Drilling Fluid System.

Figure 7:
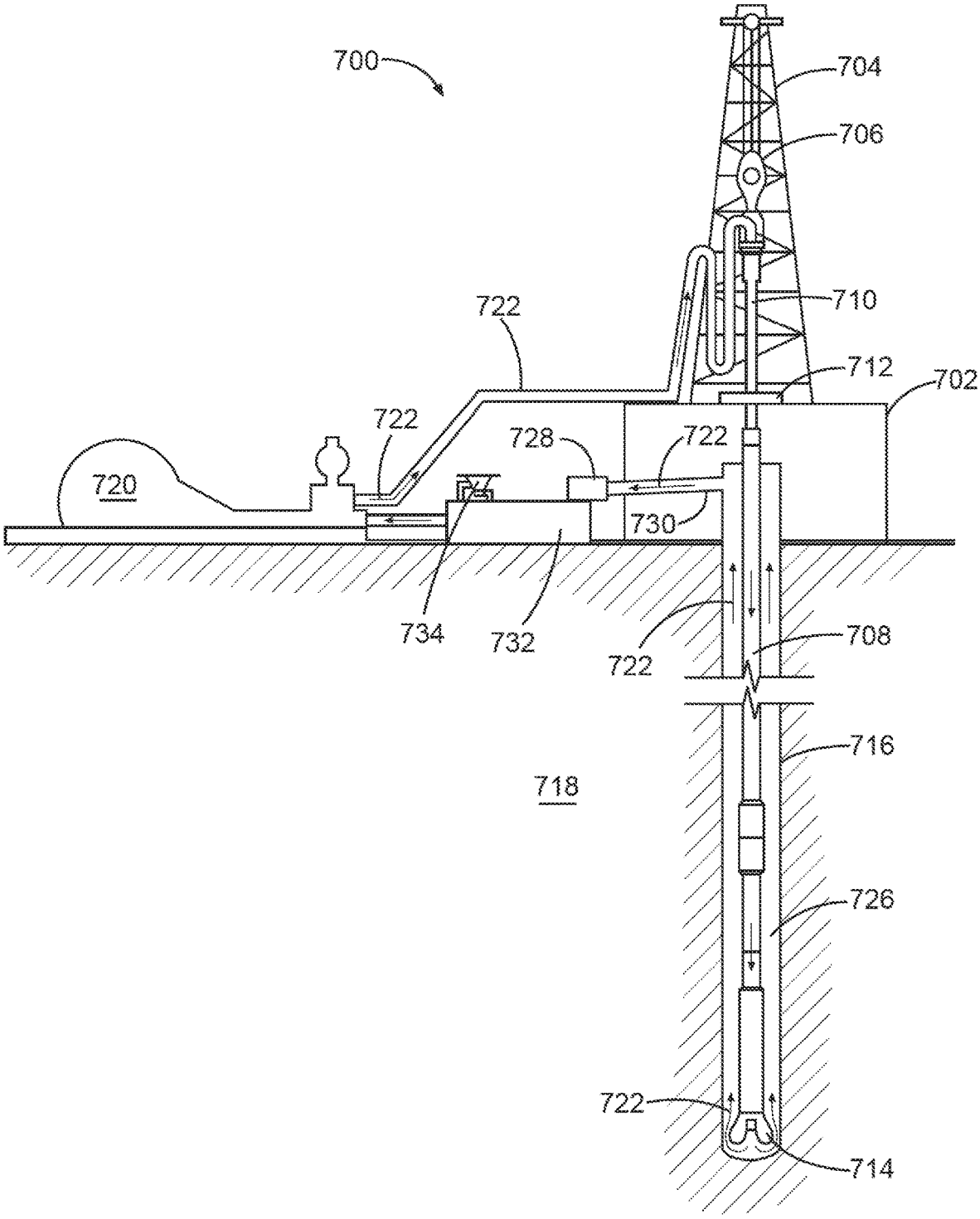
FIG. 7 illustrates a drilling assembly, in accordance with various embodiments.

FIG. 7 illustrates an exemplary drilling fluid system (e.g., wellbore drilling assembly) 700, according to one or more embodiments. It should be noted that while FIG. 7 generally depicts a land-based drilling assembly, those skilled in the art will readily recognize that the principles described herein are equally applicable to subsea drilling operations that employ floating or sea-based platforms and rigs, without departing from the scope of the disclosure.

As illustrated, the drilling assembly 700 can include a drilling platform 702 that supports a derrick 704 having a traveling block 706 for raising and lowering a drill string 708. The drill string 708 can include drill pipe and coiled tubing, as generally known to those skilled in the art. A kelly 710 supports the drill string 708 as it is lowered through a rotary table 712. A drill bit 714 is attached to the distal end of the drill string 708 and is driven either by a downhole motor and/or via rotation of the drill string 708 from the well surface. As the bit 714 rotates, it creates a wellbore 716 that penetrates various subterranean formations 718.

A pump 720 (e.g., a mud pump) circulates drilling fluid 722 through a feed pipe 724 and to the kelly 710, which conveys the drilling fluid 722 downhole through the interior of the drill string 708 and through one or more orifices in the drill bit 714. The drilling fluid 722 is then circulated back to the surface via an annulus 726 defined between the drill string 708 and the walls of the wellbore 716. At the surface, the recirculated or spent drilling fluid 722 exits the annulus 726 and can be conveyed to one or more fluid processing unit(s) 728 via an interconnecting flow line 730. After passing through the fluid processing unit(s) 728, a "cleaned" drilling fluid 722 is deposited into a nearby retention pit 732 (e.g., a mud pit). While the fluid processing unit(s) 728 is illustrated as being arranged at the outlet of the wellbore 716 via the annulus 726, those skilled in the art will readily appreciate that the fluid processing unit(s) 728 can be arranged at any other location in the drilling assembly 700 to facilitate its proper function, without departing from the scope of the disclosure.

One or more additives can be added to the drilling fluid 722 via a mixing hopper 734 communicably coupled to or otherwise in fluid communication with the retention pit 732. The mixing hopper 734 can include mixers and related mixing equipment known to those skilled in the art. In other embodiments, however, additives can be added to the drilling fluid 722 at any other location in the drilling assembly 700. In at least one embodiment, for example, there could be more than one retention pit 732, such as multiple retention pits 732 in series. Moreover, the retention pit 732 can be representative of one or more fluid storage facilities and/or units where additives can be stored, reconditioned, and/or regulated until added to the drilling fluid 722.

The fluid processing unit(s) 728 can include one or more of a shaker (e.g., shale shaker), a centrifuge, a hydrocyclone, a separator (including magnetic and electrical separators), a desilter, a desander, a separator, a filter (e.g., diatomaceous earth filters), a heat exchanger, or any fluid reclamation equipment. The fluid processing unit(s) 728 can further include one or more sensors, gauges, pumps, compressors, and the like used to store, monitor, regulate, and/or recondition the drilling fluid.

Pump 720 representatively includes any conduits, pipelines, trucks, tubulars, and/or pipes used to fluidically convey the drilling fluid to the subterranean formation; any pumps, compressors, or motors (e.g., topside or downhole) used to drive the drilling fluid into motion; any valves or related joints used to regulate the pressure or flow rate of the drilling fluid; and any sensors (e.g., pressure, temperature, flow rate, and the like), gauges, and/or combinations thereof, and the like Various downhole components contact the drilling fluid during operation, such as the drill string 708, any floats, drill collars, mud motors, downhole motors, and/or pumps associated with the drill string 708, and any measurement while drilling (MWD)/logging while drilling (LWD) tools and related telemetry equipment, sensors, or distributed sensors associated with the drill string 708. Downhole heat exchangers, valves, and corresponding actuation devices, tool seals, packers, and other wellbore isolation devices or components, and the like, can be associated with the wellbore 716. Drill bit 714 can include roller cone bits, polycrystalline diamond compact (PDC) bits, natural diamond bits, hole openers, reamers, coring bits, and the like.

Transport or delivery equipment can be used to convey the drilling fluid or additives thereof to the drilling assembly 700 such as, for example, any transport vessels, conduits, pipelines, trucks, tubulars, and/or pipes; any pumps, compressors, or motors used to drive the drilling fluid into motion; any valves or related joints used to regulate the pressure or flow rate of the drilling fluid; and any sensors (e.g., pressure and temperature), gauges, and/or combinations thereof, and the like.

The terms and expressions that have been employed are used as terms of description and not of limitation, and there is no intention in the use of such terms and expressions of excluding any equivalents of the features shown and described or portions thereof, but it is recognized that various modifications are possible within the scope of the embodiments of the present invention. Thus, it should be understood that although the present invention has been specifically disclosed by specific embodiments and optional features, modification and variation of the concepts herein disclosed may be resorted to by those of ordinary skill in the art, and that such modifications and variations are considered to be within the scope of embodiments of the present invention.

Additional Embodiments

The following exemplary embodiments are provided, the numbering of which is not to be construed as designating levels of importance:

Embodiment 1 provides a method of injecting and detecting a composition in a drilling fluid system, the method comprising:

injecting the composition into the drilling fluid system, the drilling fluid system comprising a gas detector; and detecting the composition with the gas detector.

Embodiment 2 provides the method of Embodiment 1, wherein the composition is a gas at the time of the injecting.

Embodiment 3 provides the method of any one of Embodiments 1-2, wherein the composition is a gas outside the drilling fluid system immediately before the injecting.

Embodiment 4 provides the method of any one of Embodiments 1-3, wherein the injecting comprises triggering a valve to release the composition from a storage container into the drilling fluid system.

Embodiment 5 provides the method of any one of Embodiments 1-4, wherein the injecting comprises injecting the composition through an injection orifice into the drilling fluid system, wherein the injection orifice is an orifice in a wall of a tubular that encloses at least part of the drilling fluid system.

Embodiment 6 provides the method of any one of Embodiments 1-4, wherein the injecting of the composition comprises injecting the composition through an injection tube, wherein the injection tube extends into the drilling fluid system.

Embodiment 7 provides the method of Embodiment 6, wherein the injection tube is a wand.

Embodiment 8 provides the method of Embodiment 7, wherein the drilling fluid system comprises a shale shaker and a settling pool upstream of the shale shaker, wherein the injecting of the composition comprises injecting the composition through the wand into the settling pool.

Embodiment 9 provides the method of Embodiment 8, wherein the settling pool is in a possum belly, a distribution box, a flowline trap, or a combination thereof.

Embodiment 10 provides the method of any one of Embodiments 8-9, wherein the detecting of the composition comprises extracting a gas sample from the drilling fluid system with a gas extractor that is above the settling pool, above the shale shaker, above a mud ditch downstream of the shale shaker, or a combination thereof.

Embodiment 11 provides the method of any one of Embodiments 1-10, comprising directing a gas sample from the drilling fluid system to the gas detector.

Embodiment 12 provides the method of any one of Embodiments 1-11, comprising directing a gas sample from the drilling fluid system to a gas extractor fluidically connected to the gas detector.

Embodiment 13 provides the method of Embodiment 12, comprising directing a drilling fluid sample from the drilling fluid system, the drilling fluid sample comprising the gas sample, to the gas extractor and directing the gas sample from the gas extractor to the gas detector.

Embodiment 14 provides the method of any one of Embodiments 1-13, wherein the drilling fluid system comprises a gas extractor fluidically connected to the drilling fluid system about 0 m to about 100,000 m downstream of the injecting, wherein the gas extractor is fluidically connected to the gas detector.

Embodiment 15 provides the method of Embodiment 14, wherein the gas extractor is about 0 m to about 50,000 m downstream of the injecting Embodiment 16 provides the method of any one of Embodiments 1-15, wherein the drilling fluid system comprises an inline extraction body that is fluidically connected to a gas extractor, wherein the inline extraction body provides a gas sample from the drilling fluid system to the gas extractor.

Embodiment 17 provides the method of Embodiment 16, wherein the inline extraction body comprises a suction assembly tube in a suction orifice in a wall of a tubular, the tubular at least partially enclosing the drilling fluid system, wherein a sampling end of the suction assembly tube is disposed within an inner diameter of the tubular.

Embodiment 18 provides the method of Embodiment 17, wherein the injecting of the composition comprises injecting the composition into the suction assembly tube.

Embodiment 19 provides the method of Embodiment 17-18, wherein the injecting of the composition comprises injecting the composition through the suction assembly tube in an injection tube that is within the suction assembly tube.

Embodiment 20 provides the method of Embodiment 19, wherein the injection tube has an outer diameter that is less than the inner diameter of the suction assembly tube.

Embodiment 21 provides the method of any one of Embodiments 19-20, wherein the injection tube extends into the drilling fluid system from an inner wall of the tubular by a distance that is about the same or less than a distance that the sampling end of the suction assembly tube extends into the drilling fluid system from the inner wall of the tubular.

Embodiment 22 provides the method of any one of Embodiments 19-21, wherein the injection tube extends into the drilling fluid system from an inner wall of the tubular by a distance that is about the same or greater than a distance that the sampling end of the suction assembly tube extends into the drilling fluid system from the inner wall of the tubular.

Embodiment 23 provides the method of any one of Embodiments 19-22, comprising directing a gas sample from the drilling fluid system through the suction assembly tube to a gas extractor fluidically connected to the gas detector.

Embodiment 24 provides the method of any one of Embodiments 19-23, wherein the inline extraction body comprises a first outlet and a second outlet, wherein the method comprises directing a first portion of drilling fluid in the drilling fluid system through the suction assembly tube and into a first outlet of the inline extraction body; and directing a second portion of drilling fluid in the drilling fluid system through the suction assembly tube and into a second outlet of the inline extraction body.

Embodiment 25 provides a method of injecting and detecting a gas composition in a drilling fluid system, the method comprising:

triggering a valve to release the gas composition from a storage container;

injecting the released gas composition into the drilling fluid system through an injection tube, the drilling fluid system comprising a drill string disposed in a wellbore, the drill string comprising a drill bit at a downhole end of the drill string;

an annulus between the drill string and the wellbore;

a pump configured to circulate drilling fluid through the drill string, through the drill bit, and back above-surface through the annulus;

an inline extraction body comprising a suction assembly tube in a suction orifice in a wall of a tubular, the tubular at least partially enclosing the drilling fluid system, wherein a sampling end of the suction assembly tube is disposed within an inner diameter of the tubular, wherein the injection tube extends into the drilling fluid system from the inner wall of the tubular and is within the suction assembly tube; and a gas detector;

directing a gas sample from the drilling fluid system through the suction assembly tube to a gas extractor fluidically connected to a gas detector; and detecting the gas composition with the gas detector.

Embodiment 26 provides the method of Embodiment 25, wherein the injection tube extends into the drilling fluid system from an inner wall of the tubular by a distance that is about the same or less than a distance that the sampling end of the suction assembly tube extends into the drilling fluid system from the inner wall of the tubular.

Embodiment 27 provides an injection and detection system comprising:

a drilling fluid system;

an injector configured to inject a composition into the drilling fluid system; and a gas detector configured to detect the composition.

Embodiment 28 provides the system of Embodiment 27, wherein the drilling fluid system comprises a tubular disposed in a subterranean formation.

Embodiment 29 provides the system of any one of Embodiments 27-28, wherein the drilling fluid system comprises a tubular disposed in a wellbore.

Embodiment 30 provides the system of any one of Embodiments 27-29, wherein the drilling fluid system comprises a drill string disposed in a wellbore, the drill string comprising a drill bit at a downhole end of the drill string; and an annulus between the drill string and the wellbore.

Embodiment 31 provides the system of Embodiment 30, wherein the drilling fluid system comprises a pump configured to circulate drilling fluid through the drill string, through the drill bit, and back above-surface through the annulus.

Embodiment 32 provides the system of any one of Embodiments 27-31, wherein the drilling fluid system comprises a circulating drilling fluid.

Embodiment 33 provides the system of any one of Embodiments 27-32, wherein the drilling fluid system comprises a static drilling fluid.

Embodiment 34 provides the system of any one of Embodiments 27-33, wherein the drilling fluid system is substantially free of circulating or static drilling fluid.

Embodiment 35 provides the system of any one of Embodiments 27-34, wherein the drilling fluid system comprises an aqueous drilling fluid.

Embodiment 36 provides the system of any one of Embodiments 27-35, wherein the drilling fluid system comprises an oil-based drilling fluid.

Embodiment 37 provides the system of any one of Embodiments 27-36, wherein the composition is not formed from calcium carbide.

Embodiment 38 provides the system of any one of Embodiments 27-37, wherein the composition comprises a substituted or unsubstituted ($C_2$-$C_{50}$)hydrocarbon.

Embodiment 39 provides the system of any one of Embodiments 27-38, further comprising a valve, wherein upon triggering the valve the composition is configured to be released from a storage container into the drilling fluid system.

Embodiment 40 provides the system of any one of Embodiments 27-39, wherein the drilling fluid system comprises an injection orifice through which the composition is configured to be injected into the system, wherein the injection orifice is an orifice in a wall of a tubular that encloses at least part of the drilling fluid system.

Embodiment 41 provides the system of any one of Embodiments 27-40, further comprising an injection tube that extends into the drilling fluid system, wherein the gas injector is configured to inject the composition through the injection tube and into the drilling fluid system.

Embodiment 42 provides the system of Embodiment 41, wherein the injection tube is a wand.

Embodiment 43 provides the system of Embodiment 42, wherein the drilling fluid system comprises a shale shaker and a settling pool upstream of the shale shaker, wherein the injector is configured to inject the composition through the wand into the settling pool.

Embodiment 44 provides the system of Embodiment 43, wherein the settling pool is in a possum belly, a distribution box, a flowline trap, or a combination thereof.

Embodiment 45 provides the system of any one of Embodiments 43-44, further comprising a gas extractor configured to extract a gas sample from the drilling fluid system above the settling pool, above the shale shaker, above a mud ditch downstream of the shale shaker, or a combination thereof, wherein the gas extractor is configured to direct the extracted composition to the gas detector.

Embodiment 46 provides the system of any one of Embodiments 27-45, wherein the drilling fluid system comprises a gas extractor fluidically connected to the drilling fluid system about 0 m to about 100,000 m downstream of the injector, wherein the gas extractor is fluidically connected to the gas detector.

Embodiment 47 provides the system of any one of Embodiments 27-46, wherein the drilling fluid system comprises an inline extraction body that is fluidically connected to a gas extractor, wherein the inline extraction body is configured to provide a sample from the drilling fluid system to the gas extractor.

Embodiment 48 provides the system of Embodiment 47, wherein the inline extraction body comprises a suction assembly tube in a suction orifice in a wall of a tubular, the tubular at least partially enclosing the drilling fluid system, wherein a sampling end of the suction assembly tube is disposed within an inner diameter of the tubular.

Embodiment 49 provides the system of Embodiment 48, wherein the injector is configured to inject the composition into the suction assembly tube.

Embodiment 50 provides the system of any one of Embodiments 48-49, wherein the injector is configured to inject the composition through the suction assembly tube in an injection tube that is within the suction assembly tube.

Embodiment 51 provides the system of Embodiment 50, wherein the injection tube has an outer diameter that is less than the inner diameter of the suction assembly tube.

Embodiment 52 provides the system of any one of Embodiments 50-51, wherein the injection tube extends into the drilling fluid system from an inner wall of the tubular by a distance that is about the same or less than a distance that the sampling end of the suction assembly tube extends into the drilling fluid system from the inner wall of the tubular.

Embodiment 53 provides the system of any one of Embodiments 50-52, wherein the injection tube extends into the drilling fluid system from an inner wall of the tubular by a distance that is about the same or greater than a distance that the sampling end of the suction assembly tube extends into the drilling fluid system from the inner wall of the tubular.

Embodiment 54 provides the system of any one of Embodiments 50-53, wherein the injection tube extends into the drilling fluid system from an inner wall of the tubular by a distance that differs by about 0 mm to about 500 mm from a distance the sampling end of the suction assembly tube extends into the drilling fluid system from the inner wall of the tubular.

Embodiment 55 provides the system of any one of Embodiments 50-54, wherein the suction assembly tube is configured to direct a gas sample from the drilling fluid system through the suction assembly tube to a gas extractor that is fluidically connected to the gas detector.

Embodiment 56 provides the system of any one of Embodiments 50-55, wherein the inline extraction body comprises a first outlet and a second outlet, wherein the inline extraction body is configured to direct a first portion of drilling fluid in the drilling fluid system through the suction assembly tube and into a first outlet of the inline extraction body; and the inline extraction body is configured to direct a second portion of drilling fluid in the drilling fluid system through the suction assembly tube and into a second outlet of the inline extraction body.

Embodiment 57 provides a gas injection and detection system comprising:

a drilling fluid system comprising a drill string disposed in a wellbore, the drill string comprising a drill bit at a downhole end of the drill string;

an annulus between the drill string and the wellbore;

a pump configured to circulate drilling fluid through the drill string, through the drill bit, and back above-surface through the annulus;

an inline extraction body fluidically connected to a gas extractor, the inline extraction body comprising a suction assembly tube in a suction orifice in a wall of a tubular, the tubular at least partially enclosing the drilling fluid system, wherein a sampling end of the suction assembly tube is disposed within an inner diameter of the tubular, wherein the inline extraction body is configured to provide a drilling fluid sample from the drilling fluid system to the gas extractor;

a gas detector fluidically connected to the gas extractor, wherein the gas extractor is configured to provide a gas sample from the drilling fluid sample to the gas detector; and an injection tube extending into the drilling fluid system from the inner wall of the tubular, wherein the injection tube is within the suction assembly tube.

Embodiment 58 provides the system of Embodiment 57, wherein the injection tube extends into the drilling fluid system from an inner wall of the tubular by a distance that differs from a distance that the sampling end of the suction assembly tube extends into the drilling fluid system from the inner wall of the tubular by about 0 mm to about 500 mm.

Embodiment 59 provides the system of any one of Embodiments 57-58, wherein the inline extraction body comprises a first outlet and a second outlet, wherein the first outlet is fluidically connected to a separator, and wherein the second outlet is fluidically connected to the gas extractor.

Embodiment 60 provides an injection and detection apparatus comprising:

an inline extraction body comprising a suction assembly tube configured to be placed in a suction orifice in a wall of a tubular that at least partially encloses a drilling fluid system with the sampling end of the suction assembly tube disposed within an inner diameter of the tubular, the suction assembly tube configured to direct a gas sample from the drilling fluid system to a gas detector; and an injection tube within the suction assembly tube, the injection tube configured to extend into the drilling fluid system from the inner wall of the tubular, the injection tube configured to inject a composition into the drilling fluid system.

Embodiment 61 provides the apparatus of Embodiment 60, wherein the suction assembly tube is configured to direct the gas sample to a gas extractor and subsequently to the gas detector.

Embodiment 62 provides the apparatus of any one of Embodiments 60-61, wherein the injection tube is configured to extend into the drilling fluid system from the inner wall of the tubular by a distance that differs from the distance that the sampling end of the suction assembly tube is configured to extend into the drilling fluid system from the inner wall of the tubular by about 0 mm to about 500 mm.

Embodiment 63 provides the apparatus of any one of Embodiments 60-62, wherein the suction assembly tube comprises a first outlet and a second outlet, the suction assembly tube configured to direct a first portion of a sample from the drilling fluid system comprising the gas sample to the first outlet and a second portion of the sample from the drilling fluid system comprising the gas sample to the second outlet.

Embodiment 64 provides the apparatus of any one of Embodiments 60-63, further comprising a gas extractor fluidically connected to the suction assembly tube, the gas detector fluidically connected to the gas extractor.

Embodiment 65 provides the method, apparatus, or system of any one or any combination of Embodiments 1-64 optionally configured such that all elements or options recited are available to use or select from.

What is claimed is:

1. A method of injecting and detecting a composition in a drilling fluid system, the method comprising:

injecting the composition into a settling pool of the drilling fluid system, the drilling fluid system comprising a gas detector; and detecting the composition with the gas detector.

2. The method of claim 1, wherein the composition is a gas at a time of the injecting, and/or wherein the injecting comprises triggering a valve to release the composition from a storage container into the drilling fluid system, and/or wherein the injecting comprises injecting the composition through an injection orifice into the drilling fluid system, and wherein the injection orifice is an orifice in a wall of a tubular that encloses at least part of the drilling fluid system.

3. The method of claim 1, wherein the injecting of the composition comprises injecting the composition through an injection tube, wherein the injection tube extends into the drilling fluid system.

4. The method of claim 3, wherein the injection tube extends below a surface of a drilling fluid in the settling pool, and/or wherein the drilling fluid system comprises a shale shaker downstream of the settling pool, wherein the injecting of the composition comprises injecting the composition through the injection tube into the settling pool below the surface of the drilling fluid in the settling pool, and/or wherein the settling pool is in a possum belly, a distribution box, a flowline trap, or a combination thereof, and/or wherein the detecting of the composition comprises extracting a gas sample from the drilling fluid system with a gas extractor that is above the settling pool, above the shale shaker, above a mud ditch downstream of the shale shaker, or a combination thereof.

5. The method of claim 1, comprising directing a gas sample from the drilling fluid system to a gas extractor fluidically connected to the gas detector.

6. The method of claim 1, wherein the drilling fluid system comprises a gas extractor fluidically connected to the drilling fluid system downstream of a location at which the injecting occurs, and wherein the gas extractor is fluidically connected to the gas detector.

7. The method of claim 1, wherein the drilling fluid system comprises an inline extraction body that is fluidically connected to a gas extractor, wherein the inline extraction body provides a gas sample from the drilling fluid system to the gas extractor, and/or wherein the inline extraction body comprises a suction assembly tube in a suction orifice in a wall of a tubular, the tubular at least partially enclosing the drilling fluid system, wherein a sampling end of the suction assembly tube is disposed within an inner diameter of the tubular, and/or wherein the injecting of the composition comprises injecting the composition through the suction assembly tube in an injection tube that is within the suction assembly tube.

8. The method of claim 7, wherein the injection tube has an outer diameter that is less than the inner diameter of the suction assembly tube, and/or comprising directing a gas sample from the drilling fluid system through the suction assembly tube to a gas extractor fluidically connected to the gas detector, and/or wherein the inline extraction body comprises a first outlet and a second outlet, the method further comprising:

directing a first portion of drilling fluid in the drilling fluid system through the suction assembly tube and into a first outlet of the inline extraction body; and directing a second portion of drilling fluid in the drilling fluid system through the suction assembly tube and into a second outlet of the inline extraction body.

9. A method of injecting and detecting a gas composition in a drilling fluid system, the method comprising:

triggering a valve to release the gas composition from a storage container;

injecting the released gas composition into the drilling fluid system through an injection tube, the drilling fluid system comprising a drill string disposed in a wellbore, the drill string comprising a drill bit at a downhole end of the drill string;

an annulus between the drill string and the wellbore;

a pump configured to circulate drilling fluid through the drill string, through the drill bit, and back above-surface through the annulus;

an inline extraction body comprising a suction assembly tube in a suction orifice in a wall of a tubular, the tubular at least partially enclosing the drilling fluid system, wherein a sampling end of the suction assembly tube is disposed within an inner diameter of the tubular, wherein the injection tube extends into the drilling fluid system from an inner wall of the tubular and is within the suction assembly tube; and a gas detector;

directing a gas sample from the drilling fluid system through the suction assembly tube to a gas extractor fluidically connected to a gas detector; and detecting the gas composition with the gas detector.

10. The method of claim 9, wherein the injection tube extends into the drilling fluid system from the inner wall of the tubular by a distance that is the same or less than a distance that the sampling end of the suction assembly tube extends into the drilling fluid system from the inner wall of the tubular.

11. An injection and detection system comprising:

a drilling fluid system;

an injector configured to inject a composition into a settling pool of the drilling fluid system; and a gas detector configured to detect the composition.

12. The system of claim 11, wherein the drilling fluid system comprises a tubular disposed in a subterranean formation, and/or wherein the drilling fluid system comprises a drill string disposed in a wellbore, the drill string comprising a drill bit at a downhole end of the drill string, and an annulus between the drill string and the wellbore, and/or wherein the drilling fluid system comprises a pump configured to circulate drilling fluid through the drill string, through the drill bit, and back above-surface through the annulus.

13. The system of claim 11, further comprising a valve, wherein upon triggering the valve the composition is configured to be released from a storage container into the drilling fluid system, and/or wherein the drilling fluid system comprises an injection orifice through which the composition is configured to be injected into the system, wherein the injection orifice is an orifice in a wall of a tubular that encloses at least part of the drilling fluid system.

14. The system of claim 11, further comprising an injection tube that extends into the drilling fluid system, wherein the injector is configured to inject the composition through the injection tube and into the drilling fluid system, and/or wherein the injection tube extends below a surface of a drilling fluid in the settling pool, and/or wherein the drilling fluid system comprises a shale shaker downstream of the settling pool, wherein the injector is configured to inject the composition through the injection tube into the settling pool below the surface of the drilling fluid in the settling pool, and/or wherein the settling pool is in a possum belly, a distribution box, a flowline trap, or a combination thereof, and/or further comprising a gas extractor configured to extract a gas sample from the drilling fluid system above the settling pool, above the shale shaker, above a mud ditch downstream of the shale shaker, or a combination thereof, wherein the gas extractor is configured to direct the extracted gas sample to the gas detector.

15. The system of claim 11, wherein the drilling fluid system comprises an inline extraction body that is fluidically connected to a gas extractor, wherein the inline extraction body is configured to provide a gas sample from the drilling fluid system to the gas extractor, and/or wherein the inline extraction body comprises a suction assembly tube in a suction orifice in a wall of a tubular, the tubular at least partially enclosing the drilling fluid system, wherein a sampling end of the suction assembly tube is disposed within an inner diameter of the tubular, and/or wherein the injector is configured to inject the composition through the suction assembly tube in an injection tube that is within the suction assembly tube.

16. The system of claim 15, wherein the injection tube has an outer diameter that is less than the inner diameter of the suction assembly tube, and/or wherein the suction assembly tube is configured to direct a gas sample from the drilling fluid system through the suction assembly tube to a gas extractor that is fluidically connected to the gas detector, and/or wherein the inline extraction body comprises a first outlet and a second outlet, and wherein the inline extraction body is configured to direct a first portion of drilling fluid in the drilling fluid system through the suction assembly tube and into a first outlet of the inline extraction body, and the inline extraction body is configured to direct a second portion of drilling fluid in the drilling fluid system through the suction assembly tube and into a second outlet of the inline extraction body.

17. A gas injection and detection system comprising:

a drilling fluid system comprising a drill string disposed in a wellbore, the drill string comprising a drill bit at a downhole end of the drill string;

an annulus between the drill string and the wellbore;

a pump configured to circulate drilling fluid through the drill string, through the drill bit, and back above-surface through the annulus;

an inline extraction body fluidically connected to a gas extractor, the inline extraction body comprising a suction assembly tube in a suction orifice in a wall of a tubular, the tubular at least partially enclosing the drilling fluid system, wherein a sampling end of the suction assembly tube is disposed within an inner diameter of the tubular, wherein the inline extraction body is configured to provide a drilling fluid sample from the drilling fluid system to the gas extractor;

a gas detector fluidically connected to the gas extractor, wherein the gas extractor is configured to provide a gas sample from the drilling fluid sample to the gas detector; and an injection tube extending into the drilling fluid system from an inner wall of the tubular, wherein the injection tube is within the suction assembly tube.

18. The system of claim 17, wherein the injection tube extends into the drilling fluid system from the inner wall of the tubular by a distance that differs from a distance that the sampling end of the suction assembly tube extends into the drilling fluid system from the inner wall of the tubular by 0 mm to 500 mm, and/or wherein the inline extraction body comprises a first outlet and a second outlet, wherein the first outlet is fluidically connected to a separator, and wherein the second outlet is fluidically connected to the gas extractor.

19. The system of claim 17, wherein the inline extraction body comprises a first outlet and a second outlet, wherein the first outlet is fluidically connected to a separator, and wherein the second outlet is fluidically connected to the gas extractor.

20. An injection and detection apparatus comprising:

an inline extraction body comprising a suction assembly tube configured to be placed in a suction orifice in a wall of a tubular that at least partially encloses a drilling fluid system with a sampling end of the suction assembly tube disposed within an inner diameter of the tubular, the suction assembly tube configured to direct a gas sample from the drilling fluid system to a gas detector; and an injection tube within the suction assembly tube, the injection tube configured to extend into the drilling fluid system from an inner wall of the tubular, the injection tube configured to inject a composition into the drilling fluid system.

21. The apparatus of claim 20, wherein the suction assembly tube is configured to direct the gas sample to a gas extractor and subsequently to the gas detector, and/or wherein the injection tube is configured to extend into the drilling fluid system from the inner wall of the tubular by a distance that differs from the distance that the sampling end of the suction assembly tube is configured to extend into the drilling fluid system from the inner wall of the tubular by 0 mm to 500 mm, and/or wherein the suction assembly tube comprises a first outlet and a second outlet, the suction assembly tube configured to direct a first portion of a sample from the drilling fluid system comprising the gas sample to the first outlet and a second portion of the sample from the drilling fluid system comprising the gas sample to the second outlet, and/or further comprising a gas extractor fluidically connected to the suction assembly tube, the gas detector fluidically connected to the gas extractor.

* * * * *